US008820846B2

(12) United States Patent
Jokonya

(10) Patent No.: US 8,820,846 B2
(45) Date of Patent: Sep. 2, 2014

(54) AUTOMATED PRE-TRAMMING OPERATION OF A MINING MACHINE

(75) Inventor: Persistence Jokonya, Terenure (ZA)

(73) Assignee: Joy MM Delaware, Inc., Wilmington, DE (US)

( * ) Notice: Subject to any disclaimer, the term of this patent is extended or adjusted under 35 U.S.C. 154(b) by 96 days.

(21) Appl. No.: 13/566,719

(22) Filed: Aug. 3, 2012

(65) Prior Publication Data

US 2013/0033088 A1 Feb. 7, 2013

Related U.S. Application Data

(60) Provisional application No. 61/514,542, filed on Aug. 3, 2011, provisional application No. 61/514,543, filed on Aug. 3, 2011, provisional application No. 61/514,566, filed on Aug. 3, 2011.

(51) Int. Cl.

| | |
|---|---|
| ***E21C 35/08*** | (2006.01) |
| ***E21C 31/12*** | (2006.01) |
| ***E21C 25/16*** | (2006.01) |
| *E21C 35/10* | (2006.01) |
| *E21C 35/24* | (2006.01) |
| *E21D 9/10* | (2006.01) |

(52) U.S. Cl.

CPC ..... *E21C 25/16* (2013.01); *E21C 31/12* (2013.01); *E21C 35/10* (2013.01); *E21D 9/108* (2013.01); *E21C 35/08* (2013.01); *E21C 35/24* (2013.01)

USPC ..... 299/1.4; 299/1.8; 299/30

(58) Field of Classification Search

USPC ..... 299/1.05, 1.1, 1.4, 1.8, 10, 31, 30

See application file for complete search history.

(56) References Cited

U.S. PATENT DOCUMENTS

| | | | |
|---|---|---|---|
| 3,817,578 | A | 6/1974 | Wilson |
| 3,922,015 | A | 11/1975 | Poundstone |
| 4,008,921 | A | 2/1977 | Czauderna et al. |
| 4,079,997 | A | 3/1978 | Bienko et al. |
| 4,143,552 | A | 3/1979 | Godfrey |
| 4,192,551 | A | 3/1980 | Weimer et al. |
| 4,200,335 | A | 4/1980 | Moynihan et al. |

(Continued)

FOREIGN PATENT DOCUMENTS

| | | |
|---|---|---|
| CA | 2333781 | 7/2002 |
| CA | 2530525 | 1/2005 |

(Continued)

OTHER PUBLICATIONS

International Preliminary Search Report on Patentability for Application No. PCT/US12/49532 dated Aug. 30, 2013 (21 pages).

(Continued)

*Primary Examiner* — David Bagnell
*Assistant Examiner* — Michael Goodwin
(74) *Attorney, Agent, or Firm* — Michael Best & Friedrich LLP

(57) ABSTRACT

Methods and systems for automatically operating a continuous mining machine. One method includes accessing at least one coordinate of a cutting face stored in a computer-readable medium, automatically operating a first actuator to position a platform a predetermined clearance distance from the at least one coordinate, the platform supporting a cutterhead, and automatically operating a second actuator to position an arm at a tramming position after positioning the platform the predetermined clearance distance from the at least one coordinate, the arm coupled to the platform and including the cutterhead.

22 Claims, 24 Drawing Sheets

(56) References Cited

U.S. PATENT DOCUMENTS

| | | | |
|---|---|---|---|
| 4,323,280 | A | 4/1982 | Lansberry et al. |
| 4,351,565 | A | 9/1982 | Takahashi et al. |
| 4,428,618 | A | 1/1984 | Fecitt |
| 4,588,230 | A | 5/1986 | Schupphaus |
| 4,753,484 | A | 6/1988 | Stolarczyk et al. |
| 4,822,105 | A | 4/1989 | Yamada et al. |
| 4,884,847 | A | 12/1989 | Bessinger et al. |
| 4,887,935 | A | 12/1989 | Koppers et al. |
| 4,968,098 | A | 11/1990 | Hirsch et al. |
| 4,981,327 | A | 1/1991 | Bessinger et al. |
| 5,106,162 | A | 4/1992 | Lewins et al. |
| 5,116,103 | A | 5/1992 | Lewins et al. |
| 5,362,133 | A | 11/1994 | Geuns |
| 5,448,479 | A | 9/1995 | Kemner et al. |
| 5,469,356 | A | 11/1995 | Hawkins et al. |
| 5,483,455 | A | 1/1996 | Lay et al. |
| 5,553,925 | A | 9/1996 | Merten et al. |
| 5,586,030 | A | 12/1996 | Kemner et al. |
| 5,615,116 | A | 3/1997 | Gudat et al. |
| 5,631,658 | A | 5/1997 | Gudat et al. |
| 5,646,845 | A | 7/1997 | Gudat et al. |
| 5,648,901 | A | 7/1997 | Gudat et al. |
| 5,838,562 | A | 11/1998 | Gudat et al. |
| 5,877,723 | A | 3/1999 | Fan |
| 5,906,646 | A | 5/1999 | Kemner |
| 5,913,914 | A | 6/1999 | Kemner et al. |
| 5,925,081 | A | 7/1999 | Hawkins et al. |
| 5,938,288 | A | 8/1999 | Saint-Pierre et al. |
| 5,956,250 | A | 9/1999 | Gudat et al. |
| 5,961,560 | A | 10/1999 | Kemner |
| 5,967,616 | A | 10/1999 | Offutt et al. |
| 5,999,865 | A | 12/1999 | Bloomquist et al. |
| 6,002,362 | A | 12/1999 | Gudat |
| 6,055,042 | A | 4/2000 | Sarangapani |
| 6,062,650 | A | 5/2000 | Smith et al. |
| 6,132,005 | A | 10/2000 | Mazlin et al. |
| 6,351,697 | B1 | 2/2002 | Baker |
| 6,361,119 | B1 | 3/2002 | Kussel |
| 6,393,362 | B1 | 5/2002 | Burns |
| 6,442,456 | B2 | 8/2002 | Burns et al. |
| 6,612,655 | B2 | 9/2003 | Schwoebel et al. |
| 6,616,244 | B2 | 9/2003 | Hakkinen |
| 6,633,800 | B1 | 10/2003 | Ward et al. |
| 6,666,521 | B1 | 12/2003 | Pease et al. |
| 6,694,233 | B1 | 2/2004 | Duff et al. |
| 6,799,100 | B2 | 9/2004 | Burns et al. |
| 6,857,705 | B2 | 2/2005 | Hainsworth et al. |
| 6,898,503 | B2 | 5/2005 | Makela et al. |
| 7,181,370 | B2 | 2/2007 | Furem et al. |
| 7,191,060 | B2 | 3/2007 | Makela et al. |
| 7,360,844 | B2 | 4/2008 | Frederick et al. |
| 7,392,151 | B2 | 6/2008 | Makela |
| 7,477,967 | B2 | 1/2009 | Makela |
| 7,519,462 | B2 | 4/2009 | Brown et al. |
| 7,574,821 | B2 | 8/2009 | Furem |
| 7,578,079 | B2 | 8/2009 | Furem |
| 7,643,934 | B2 | 1/2010 | Makela |
| 7,656,342 | B2 | 2/2010 | Stolarczyk et al. |
| 7,659,847 | B2 | 2/2010 | Bausov et al. |
| 7,695,071 | B2 | 4/2010 | Jackson et al. |
| 7,725,232 | B2 | 5/2010 | Makela et al. |
| 7,831,345 | B2 | 11/2010 | Heino et al. |
| 7,899,599 | B2 | 3/2011 | Makela et al. |
| 8,128,176 | B2 | 3/2012 | Klabisch et al. |
| 2006/0087443 | A1 | 4/2006 | Frederick et al. |
| 2007/0168100 | A1 | 7/2007 | Danko |
| 2007/0216216 | A1 | 9/2007 | Baird, Jr. et al. |
| 2008/0027610 | A1 | 1/2008 | Shull |
| 2008/0156531 | A1 | 7/2008 | Boone et al. |
| 2009/0058172 | A1 | 3/2009 | de Andrade et al. |
| 2009/0212216 | A1 | 8/2009 | Hargrave et al. |
| 2010/0114808 | A1 | 5/2010 | Mintah |
| 2010/0138094 | A1 | 6/2010 | Stark et al. |
| 2010/0327650 | A1 | 12/2010 | Junker et al. |
| 2011/0153541 | A1 | 6/2011 | Koch et al. |
| 2011/0248548 | A1 | 10/2011 | Junker et al. |
| 2012/0035798 | A1 | 2/2012 | Barfoot et al. |
| 2012/0038205 | A1 | 2/2012 | Mundry et al. |
| 2012/0091782 | A1 | 4/2012 | Wesselmann et al. |
| 2012/0095639 | A1 | 4/2012 | Makela et al. |
| 2012/0095640 | A1 | 4/2012 | Lehtinen et al. |
| 2012/0098325 | A1 | 4/2012 | Junker et al. |
| 2012/0116666 | A1 | 5/2012 | Makela |
| 2012/0146387 | A1 | 6/2012 | Shatters |
| 2012/0191431 | A1 | 7/2012 | Dunbabin et al. |
| 2012/0305025 | A1 | 12/2012 | Helbig et al. |
| 2013/0006484 | A1 | 1/2013 | Avitzur et al. |

FOREIGN PATENT DOCUMENTS

| | | |
|---|---|---|
| CA | 2530795 | 1/2005 |
| GB | 1044761 | 10/1966 |
| GB | 1123374 | 8/1968 |
| GB | 1383756 | 2/1975 |
| GB | 1466497 | 3/1977 |
| GB | 2042024 | 9/1980 |
| GB | 2174443 | 11/1986 |
| GB | 2212535 | 7/1989 |
| WO | WO 2005/052515 | 6/2005 |
| WO | WO 2008/100201 | 8/2008 |
| WO | WO 2009/145694 | 12/2009 |
| WO | WO 2010/149852 | 12/2010 |
| WO | WO 2010/149856 | 12/2010 |
| WO | WO 2011/020484 | 2/2011 |
| WO | WO 2011/141619 | 11/2011 |
| WO | WO 2011/141629 | 11/2011 |

OTHER PUBLICATIONS

PCTUS2012049532 International Search Report and Written Opinion dated Oct. 16, 2012, 24 pages.

United States Patent and Trademark Office Action for U.S. Appl. No. 13/566,544 dated Aug. 28, 2013 (25 pages).

Office Action from the United States Patent and Trademark Office for U.S. Appl. No. 13/566,696 dated Dec. 30, 2013 (39 pages).

Office Action from the United States Patent and Trademark Office for U.S. Appl. No. 13/566,737 dated Jan. 2, 2014 (33 pages).

AUTOMATED PRE-TRAMMING OPERATION OF A MINING MACHINE

RELATED APPLICATIONS

The present application claims priority to U.S. Provisional Patent Application No. 61/514,542 filed Aug. 3, 2011, U.S. Provisional Patent Application No. 61/514,543 filed Aug. 3, 2011, and U.S. Provisional Patent Application No. 61/514,566 filed Aug. 3, 2011, the entire contents of which are each hereby incorporated by reference. The present application also incorporates by reference the entire contents of U.S. Non-Provisional patent application Ser. No. 13/566,462, filed Aug. 3, 2012 and titled "MATERIAL HANDLING SYSTEM FOR MINING MACHINE" and U.S. Non-Provisional patent application Ser. No. 13/566,150, filed Aug. 3, 2012 and titled "STABILIZATION SYSTEM FOR A MINING MACHINE".

BACKGROUND

Embodiments of the present invention relate to automated operation of mining machines, such as hard rock continuous mining machines.

Traditionally, hard rock excavation is performed using explosive excavation or mechanical excavation. Explosive excavation involves drilling a pattern of small holes into the rock being excavated and loading the holes with explosives. The explosives are then detonated in a sequence designed to fragment the required volume of rock. The fragmented rock is then removed by loading and transport equipment. The violent nature of the rock fragmentation prevents automation of the explosive process and, consequently, makes the process inefficient and unpredictable.

Mechanical excavation eliminates the use of explosives and uses rolling-edge disc cutter technology to fragment rock for excavation. Rolling-edge disc cutters, however, require the application of very large forces to crush and fragment the rock under excavation. For example, the average force required per cutter is about 50 tons and typical peak forces experienced by each cutter are often more than 100 tons. Given these force requirements, it is common to arrange multiple cutters (e.g., 50 cutters) in an array that transverses the rock in closely-spaced, parallel paths. These arrays of cutters can weigh up to 800 tons or more and often require electrical power in the order of thousands of kilowatts. As such, this machinery can only be economically employed on large projects, such as water and power supply tunnels.

Oscillating disc mining machines (often referred to as hard rock continuous miners) overcome many of the issues related to rolling-edge disc cutters. Oscillating disc mining machines use eccentrically-driven disc cutters to cut material. Due to the oscillating nature of the disc cutters, oscillating disc mining machines require less force to fragment material than rolling-edge disc cutters. Accordingly, oscillating disc mining machines are more efficient to operate than rolling-edge disc cutters. Oscillating disc mining machines, however, still suffer from issues related to operator safety and inefficient operation. In particular, to manually operate the machine often requires that an operator be located close to the machine to observe its operation.

SUMMARY

Embodiments of the invention therefore provide a method for automatically operating a continuous mining machine. The method includes accessing at least one coordinate of a cutting face stored in a computer-readable medium, automatically operating a first actuator to position a platform a predetermined clearance distance from the at least one coordinate, the platform supporting a cutterhead, and automatically operating a second actuator to position an arm at a tramming position after positioning the platform the predetermined clearance distance from the at least one coordinate, the arm coupled to the platform and including the cutterhead.

Another embodiment of the invention provides a system for automatically operating a continuous mining machine. The system includes a platform, an arm coupled to the platform and including a cutterhead, a first actuator configured to move the platform linearly, and a second actuator configured to swing the arm horizontally. The system also includes a control system configured to perform an automated pre-tramming operation without requiring manual interaction. The control system performs the automated pre-tramming operation by (i) accessing at least one coordinate of a cutting face stored in a computer-readable medium, (ii) operating the first actuator to position the platform a predetermined clearance distance from the at least one coordinate, and (ii) operating the second actuator to swing the arm to a predetermined tramming position after positioning the platform the predetermined clearance distance from the at least one coordinate.

Yet another embodiment of the invention provides a system for automatically operating a continuous mining machine. The system includes a platform, an arm coupled to the platform and including a cutterhead, a first actuator configured to move the platform linearly, and a second actuator configured to swing the arm horizontally. The system also includes a control system configured to (i) automatically access at least one coordinate of a cutting face, (ii) automatically operate the first actuator to position the platform a predetermined distance from the at least one coordinate, (iii) automatically operate the second actuator to swing the arm to a tramming position after positioning the platform the predetermined distance from the at least one coordinate, (iv) automatically operate the first actuator to position the platform at a predetermined cutting position after swinging the arm to the tramming position. The control system is also configured to (v) tram the machine after the platform is positioned at the cutting position.

DETAILED DESCRIPTION

Figure 1:
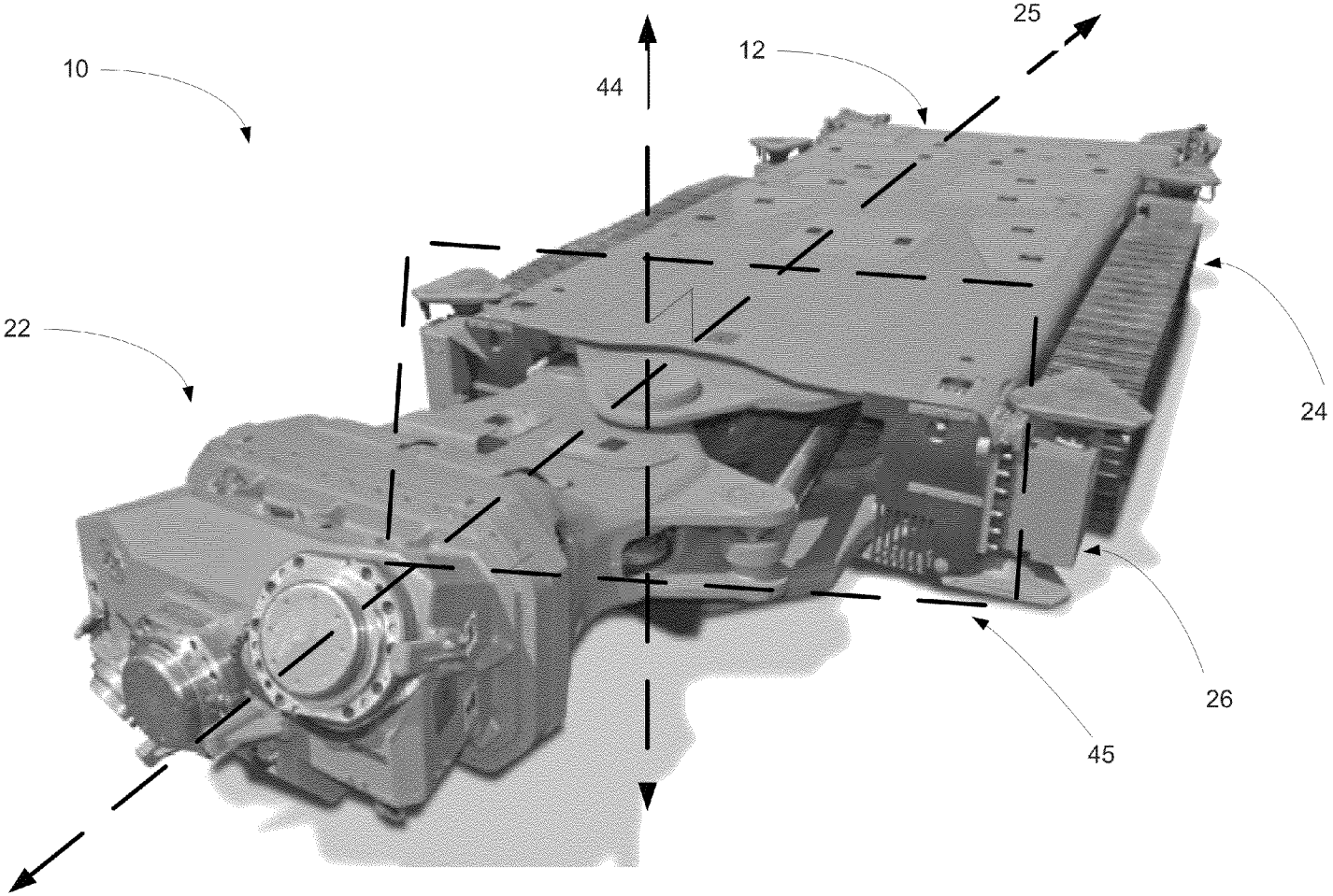
FIG. 1 illustrates a hard rock continuous mining machine.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, the methods, operations, and sequences described herein can be performed in various orders. Therefore, unless otherwise indicated herein, no required order is to be implied from the order in which elements, steps, or limitations are presented in the detailed description or claims of the present application. Also unless otherwise indicated herein, the method and process steps described herein can be combined into fewer steps or separated into additional steps.

In addition, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

FIG. 1 illustrates a continuous mining machine 10. The machine 10 includes a body or frame 12, a cutting mechanism 22 pivotably attached to the frame 12, and a pair of tracks 24 that drive the machine 10. The machine 10 has a longitudinal axis 25 that is parallel to a direction of travel of the machine 10. Each track 24 is driven by a motor (e.g., a hydraulic motor) to tram the mining machine 10, and the motors are controlled and synchronized to provide for forward, reverse, parking, and turning actions. In some embodiments, the mining machine 10 also includes a stabilization system 26 that helps stabilize and position (e.g., level) the mining machine 10 during operation.

Figure 2:
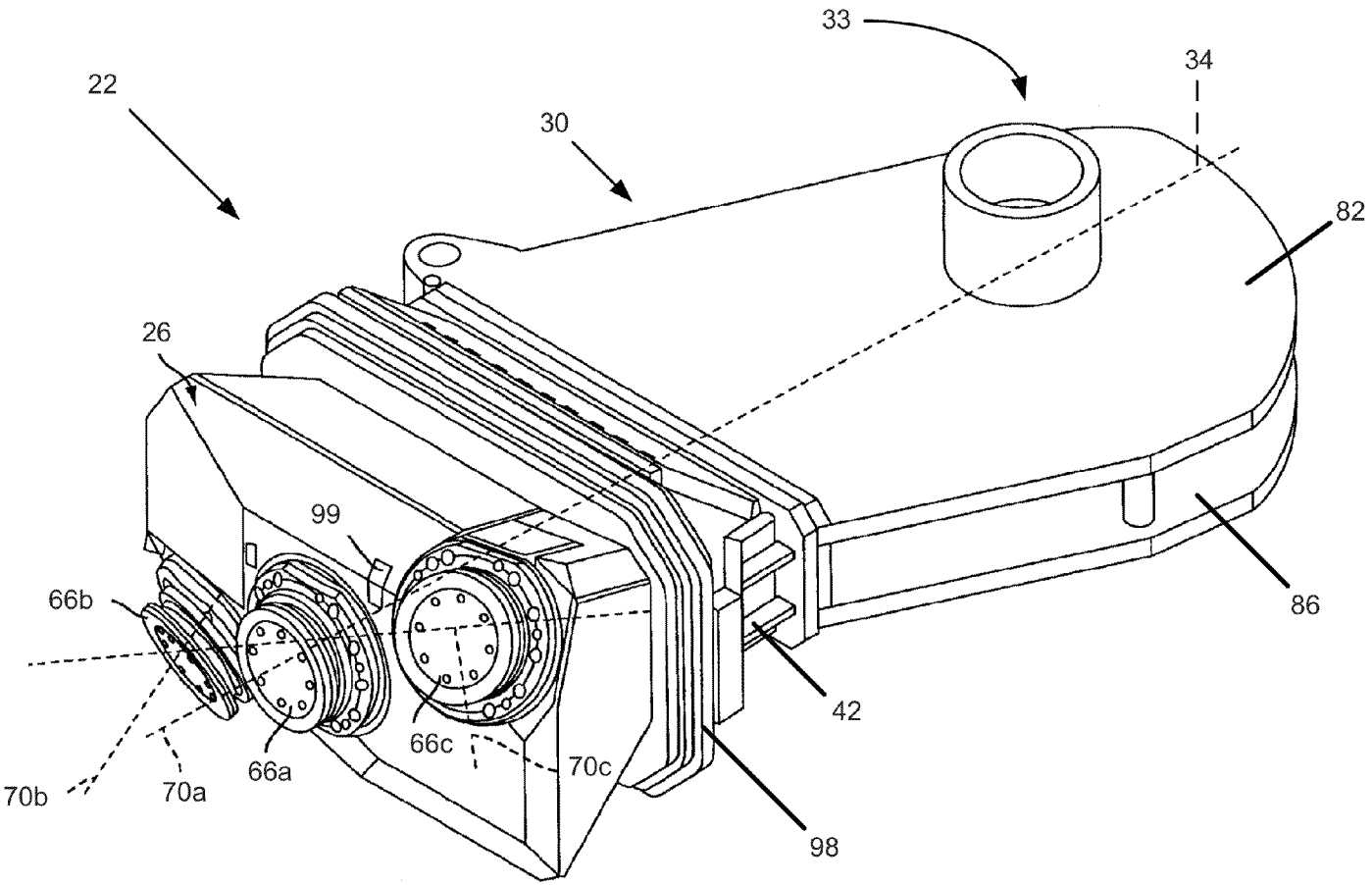
FIG. 2 is a perspective view of the cutting mechanism of the mining machine of FIG. 1.
Figure 3:
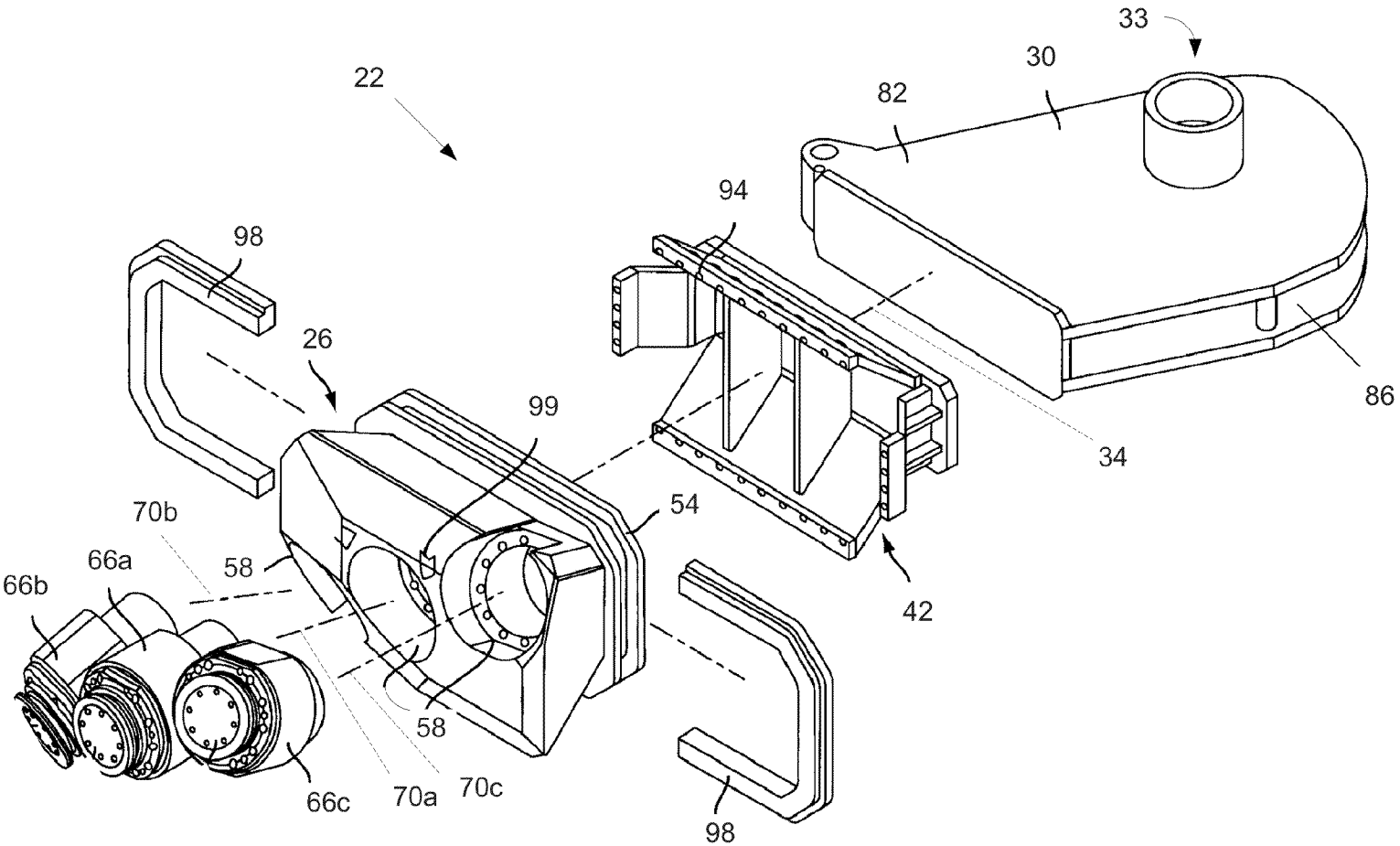
FIG. 3 is a perspective, exploded view of the cutting mechanism of FIG. 2.

As shown in FIGS. 2 and 3, the cutting mechanism 22 includes a cutterhead 26, an arm or cutterboom 30 having a longitudinal axis 34, and a bracket 42 for attaching the cutterhead 26 to the arm 30. The arm 30 pivots on a pivoting axis 44 at the front of the frame 12. The front of the frame 12 closest to the arm 30 defines a vertical plane 45 that includes the pivoting axis 44 and is perpendicular to the longitudinal axis 25. Within the context of the present application and unless otherwise noted, when a position of the arm 30 is specified as an angle, the plane 45 serves as a reference point for the specified angle. For example, if the arm 30 is positioned at approximately 90 degrees, it is positioned approximately 90 degrees from the plane 45 (e.g., approximately parallel to the longitudinal axis 25 of the frame 12 of the mining machine 10).

The cutterhead 26 includes a flange 54 and three openings 58 (see FIG. 3). Each opening 58 releasably receives a disc cutter assembly 66. The disc cutter assemblies 66 are spaced apart from one another and oriented along separate axes. Each disc cutter assembly 66 defines a longitudinal axis of rotation 70 (shown as 70*a*, 70*b*, and 70*c*), and the disc cutter assemblies 66 are mounted at an angle such that the axes of rotation 70 of the assemblies 66 are not parallel and do not intersect. For example, as shown in FIG. 2, the axis 70*a* of the center disc cutter assembly 66*a* is substantially coaxial with the longitudinal axis 34 of the arm 30. The axis 70*b* of the lower disc cutter assembly 66*b* is at an angle to the axis 70*a* of the center disc cutter assembly 66*a*. The axis 70*c* of the upper disc cutter assembly 66*c* is at an angle to the axes 70*a*, 70*b* of the center disc cutter assembly 66*a* and the lower disc cutter assembly 66*b*. This arrangement of the disc cutter assemblies 66 produces even cuts when the cutterhead 26 engages the material. Further embodiments may include fewer or more cutting disc assemblies 66 arranged in various positions.

Figure 4:
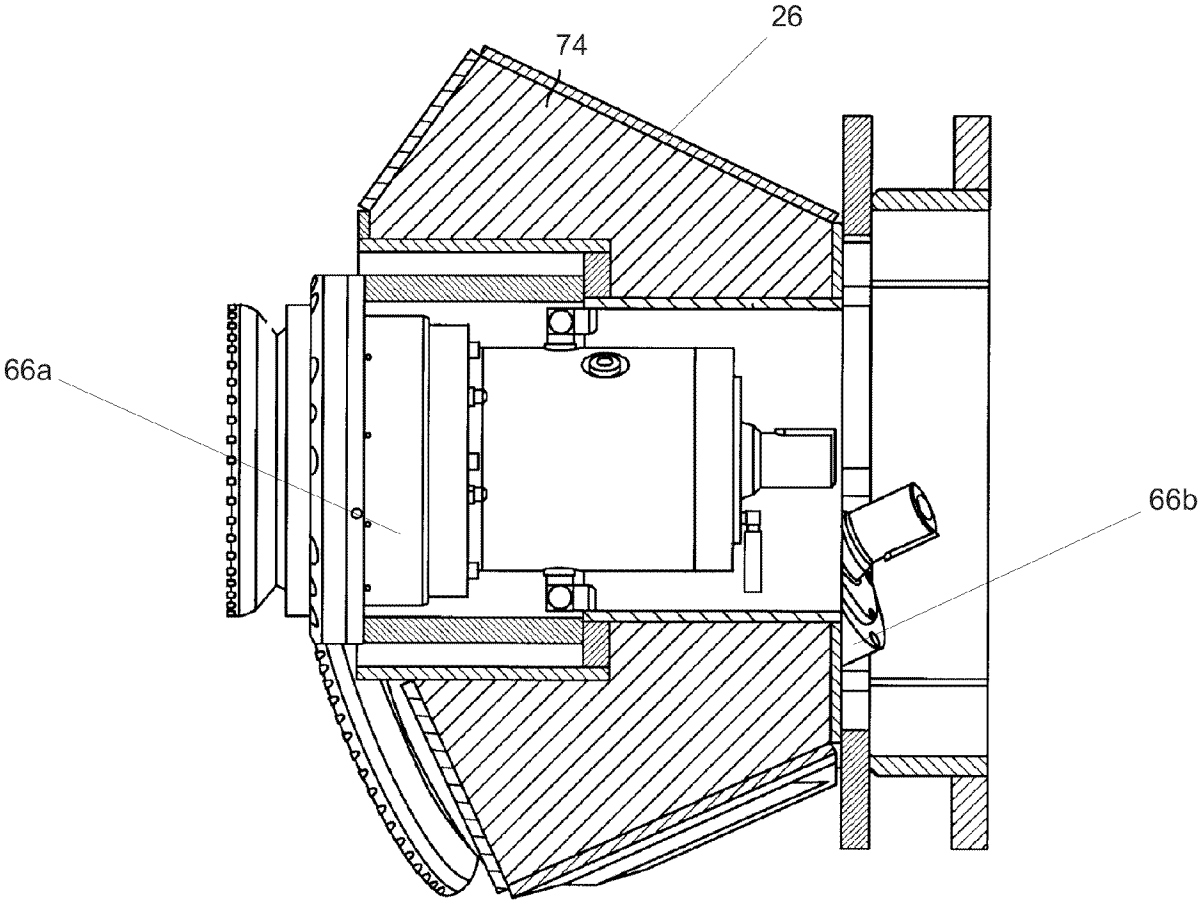
FIG. 4 is a partial cross-sectional view of a cutterhead of the cutting mechanism of FIG. 2 taken along axis 34 in FIG. 2.

As shown in FIG. 4, the cutterhead 26 also includes an absorption mass 74, in the form of a heavy material, such as lead, located in an interior volume of the cutterhead 26 surrounding the three openings 58. By having the three eccentrically driven disc cutter assemblies 66 share a common heavy weight, less overall weight is necessary and permits a lighter and more compact design. In one embodiment, approximately 6 tons is shared among the three disc cutter assemblies 66. The mounting arrangement is configured to react to the approximate average forces applied by each disc cutter assembly 66, while peak cutting forces are absorbed by the absorption mass 74, rather than being absorbed by the arm 30 or other support structure. The mass of each disc cutter assembly 66 is relatively smaller than the absorption mass 74.

As shown in FIG. 3, the arm 30 includes a top portion 82 and a bottom portion 86. The bracket 42 includes a flange 94. The bracket 42 is secured to the arm 30 by any suitable fashion, such as welding. The bracket 42 is attached to the cutterhead 26 by U-shaped channels 98. Each channel 98 receives the cutterhead flange 54 and the bracket flange 94 to secure the cutterhead 26 to the bracket 42. A resilient sleeve (not shown) is placed between the cutterhead 26 and the bracket 42 to isolate cutterhead vibrations from the arm 30.

The disc cutter assemblies 66 are driven to move in an eccentric manner by cutter motors. This is accomplished, for instance, by driving the disc cutter assemblies 66 using a drive shaft (not shown) having a first portion defining a first axis of rotation and a second portion defining a second axis of rotation that is radially offset from the first axis of rotation. The magnitude of eccentric movement is proportional to the amount of radial offset between the axis of rotation of each portion of the shaft. In one embodiment, the amount of offset is a few millimeters, and the disc cutter assembly 66 is driven eccentrically through a relatively small amplitude at a high frequency, such as approximately 3000 RPM.

The eccentric movement of the disc cutter assemblies 66 creates a jackhammer-like action against the material, causing tensile failure of the rock so that chips of rock are displaced from the rock surface. In particular, action of the disc cutter assemblies 66 against the face is similar to that of a chisel in developing tensile stresses in a brittle material, such as rock, which is caused effectively to fail in tension. The force required to produce tensile failure in the rock is an order of magnitude less than that required by conventional rolling-edge disc cutters to remove the same amount of rock. In some embodiments, the disc cutter assemblies 66 could also nutate such that the axis of rotation 70 moves in a sinusoidal manner as the disc cutter assembly 66 oscillates. This could be accomplished by making the axis about which the disc cutter drive shaft rotates angularly offset from a disc cutter housing. As illustrated in FIG. 2, a water jet 99 is mounted adjacent to the front of each disc cutter assembly 66 and is positioned to direct water toward the material. The water jet 99 sprays water or other fluid toward the material being mined to help dislodge and remove fragmented material and contain dust generated during mining.

The mining machine 10 is operated by advancing the arm 30 toward the material (i.e., toward a cutting face) and swinging the arm 30 to cut the material. During operation, the lower disc cutter assembly **66*b* is the first to contact the material when the arm 30 is swung in a clockwise direction (as viewed from the top of the arm 30 in FIG. 2). As the lower disc cutter assembly 66*b* contacts the material, dislodged material falls away from the cutting face. The center disc cutter assembly 66*a* contacts the material after the lower disc cutter assembly 66*b*, and material dislodged by the center disc cutter assembly 66*a* falls away from the cutting face through a space created by the lower disc cutter assembly 66*b*. Likewise, the upper disc cutter assembly 66*c* engages the material after the center disc cutter assembly 66*a*, and material dislodged by the upper disc cutter assembly 66*c* falls to the ground or mine floor through a spaced created by the center disc cutter assembly 66*a*. Accordingly, because the disc cutter assemblies 66 contact the material from the lowest position to a highest position, the material dislodged by leading disc cutters is not re-crushed by trailing disc cutters, which reduces wear on the disc cutters assemblies 66. In addition, the disc cutter assemblies 66 are positioned so that each disc cutter 66 cuts equal depths into the material, which prevents unevenness in the material that can obstruct progress of the mining machine 10**.

Figure 5:
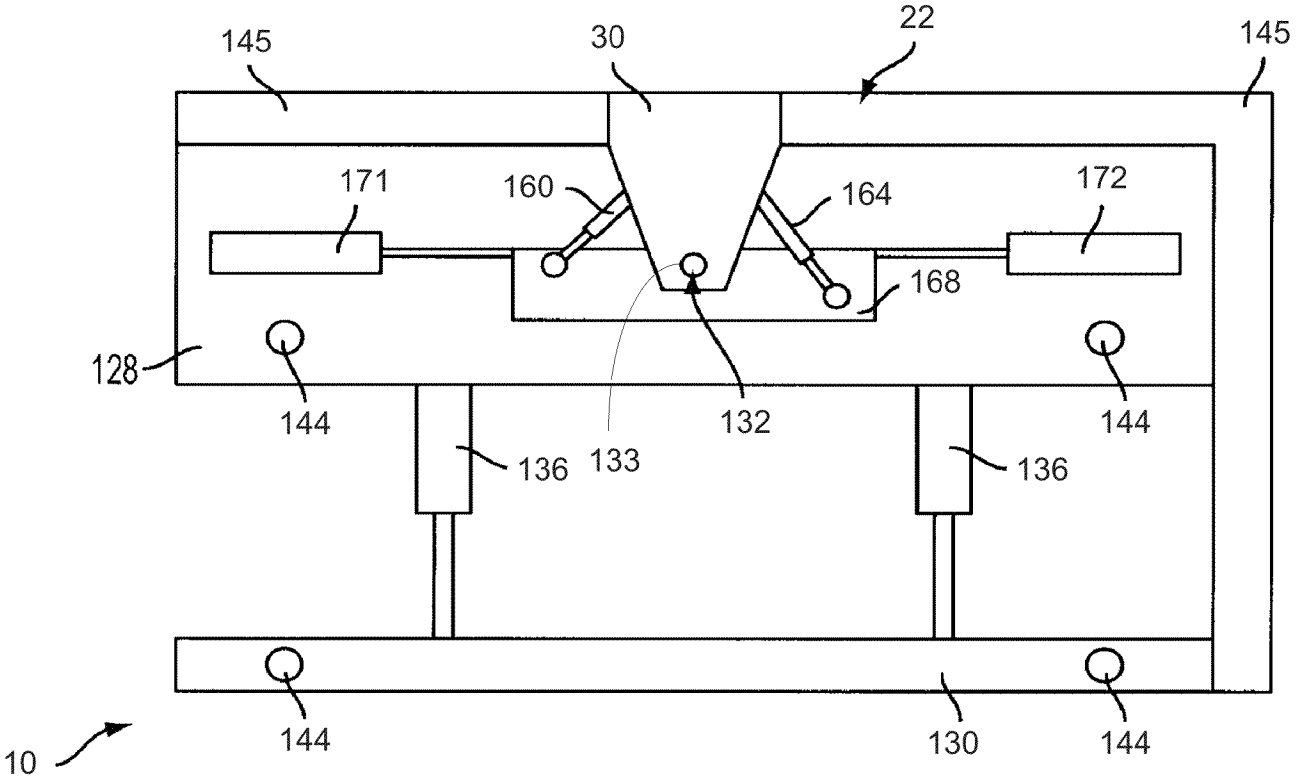
FIG. 5 is a schematic partial top view of the mining machine of FIG. 1.

FIG. 5 is a partial top view of the mining machine 10. As schematically illustrated in FIG. 5, the frame 12 of the machine 10 includes a forward platform 128 and a rearward platform 130. The machine 10 also includes a one or more actuators 136 for moving the forward platform 128 forward (e.g., toward the material). In some embodiments, the actuators 136 can also move the rearward platform 130 forward (e.g., toward the forward platform 128). For example, in some embodiments, the platforms 128 and 130 can be anchored to the floor or ground to provide support using an anchoring system. When one of the platforms 128 and 130 is anchored, the actuators 136 may only move the non-anchored platform. The anchoring system can include drills 144 secured to each platform 128 and 130 that can be extended into the floor. As used within the present application, an actuator can include a hydraulic actuator (e.g., hydraulic cylinders or pistons), a pneumatic actuator, an electric actuator (e.g., a switch or relay or a piezoelectric actuator), a mechanical actuator (e.g., a screw or cam actuator), or another type of mechanism or system for moving a component of the mining machine.

In some embodiments, a material handling system can be used with the mining machine 10. The material handling system can include scrappers, a vacuum system, a breaker or crusher to break oversized material, and a conveyor system 145 (see FIG. 5). The material handling system moves cut material away from the cutting face. Portions of the material handling system can be mounted on or off of the mining machine 10. For example, the conveyor system 145 can be positioned under the arm 30 and along at least one side of the machine 10 to collect and carry dislodged material. Similarly, the vacuum system can be mounted off of the machine 10. As described in more detail below (see FIG. 8), some components of the material handling system can be controlled by a controller included in the mining machine 10. In particular, one or more controllers included in the mining machine 10 can transmit commands to the material handling system through a wired or wireless link. In some embodiments, components of the material handling system can also be controlled manually locally or via a remote control unit.

As illustrated in FIG. 5, the arm 30 is mounted on an advance platform or slidable frame 168 that slides along a rail (not shown) on the forward platform 128. One or more actuators ("advance actuators 171 and 172") are anchored to the forward platform 128 and move the advance platform 168 linearly along the rail. Therefore, the arm 30, which is coupled to the advance platform 168, is translatable relative to the forward platform 128. The positions of the advance actuators 171 and 172 are matched to prevent unintended skewing of the advance platform 168. In some embodiments, the extension of the advance platform 168 (i.e., the extension of the actuators 171 and 172) can range from 0 millimeters (i.e., not extended) to approximately 1500 millimeters (i.e., fully extended). In the descriptions that follow, the position of the advance platform 168 can be represented by an extension of the advance actuators 171 and 172. In some embodiments, each advance actuator 171 and 172 has a stroke of approximately 200 millimeters.

The arm 30 swings horizontally side-to-side on the pivoting axis 44 to drive the disc cutter assemblies 66 into the material. In particular, the arm 30 is mounted to the advance platform 168 at the pivoting axis 44 using a pivot assembly 132. The pivot assembly 132 includes a pivot 133 that allows the arm 30 to swing horizontally. The arm 30 swings side-to-side using one or more actuators ("swing actuators 160 and 164"), which are connected between the arm 30 and the advance platform 168. The swing actuators 160 and 164 can be configured to swing the arm 30 through a maximum arc of approximately 150 degrees. In some embodiments, the machine 10 also includes a rotary actuator that rotates the arm 30, which increases a degree of arm rotation and improves positioning of the cutting mechanism 22.

Figure 6:
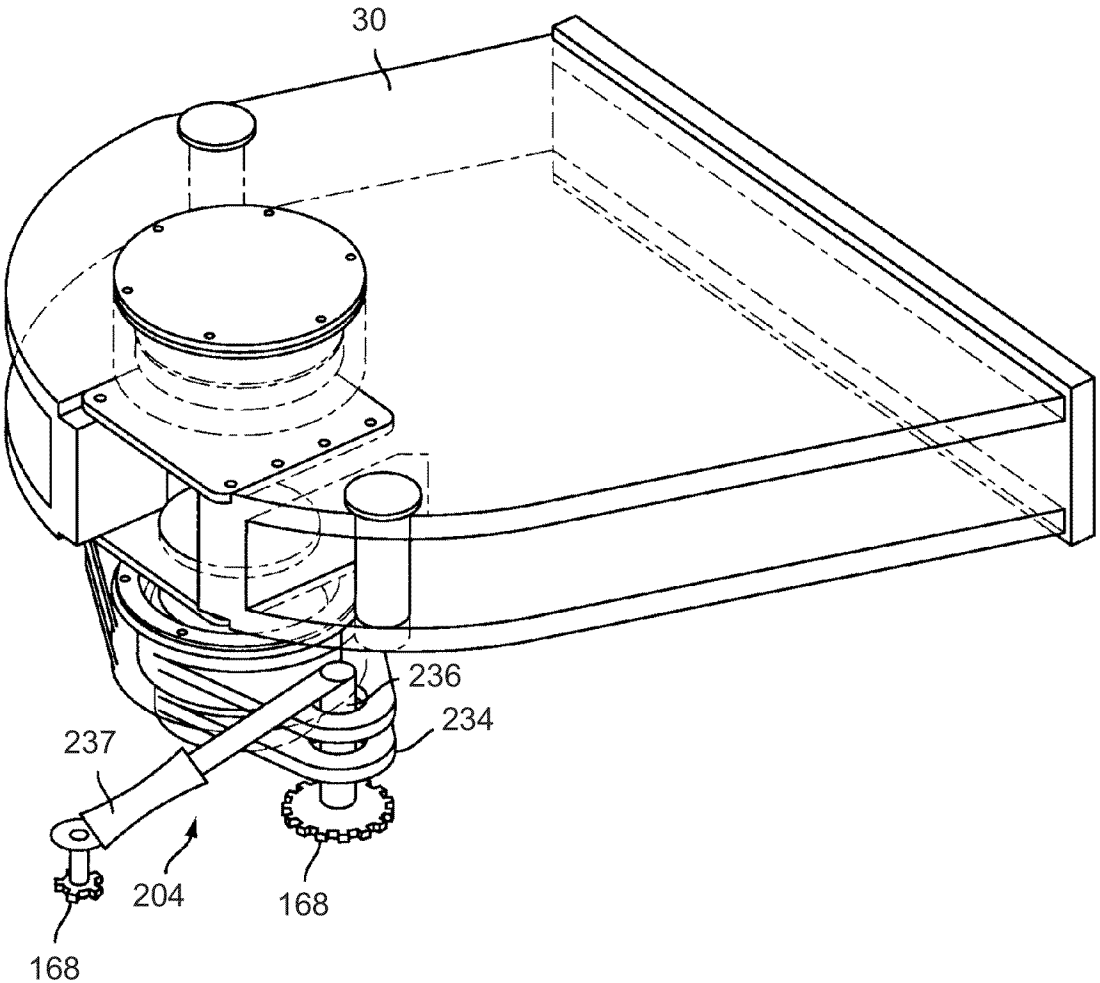
FIG. 6 is a perspective view of a pivot mechanism for mounting an arm of the mining machine of FIG. 1.
Figure 7:
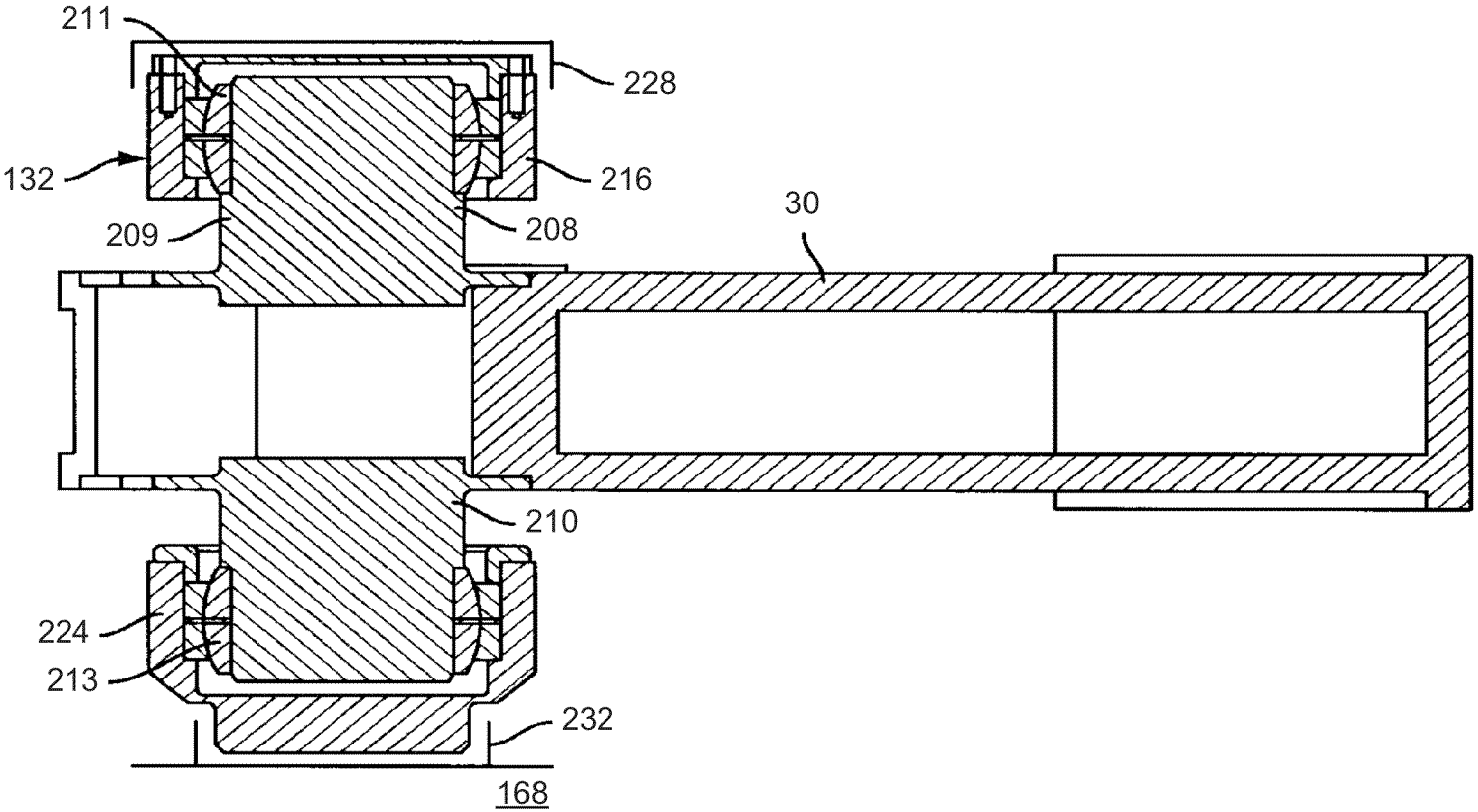
FIG. 7 is a cross-sectional view of the pivot mechanism and arm of FIG. 6.

The arm 30 also moves vertically top-to-bottom (i.e., changes the elevation of the arm 30). For example, as illustrated in FIGS. 6 and 7, the pivot assembly 132, which allows the arm 30 to swing horizontally, can include an additional pivot assembly 204 that allows the arm 30 to pivot or tilt vertically. The pivot assembly 204 includes a split support pin 208 that includes a top pin 209 and a bottom pin 210. The top pin 209 is attached to the top of the arm 30 and a bottom pin 210 is attached to the bottom of the arm 30. The arm 30 is mounted on the top pin 209 by an upper spherical bearing 211 between an upper spherical bearing housing 216 and the top pin 209, and the arm 108 is mounted on the bottom pin 210 by a lower spherical bearing 213 between a lower spherical bearing housing and the bottom pin 210. Each of the spherical bearing housings 216 and 224 are held stationary relative to the arm platform 168 by receptacles 228 and 232, as shown schematically in FIG. 7.

To move the arm 30 vertically top-to-bottom (i.e., tilt the cutting mechanism 22), a lever 234 is attached to the lower spherical bearing housing 224 (see FIG. 6). A pin 236 is attached to the lever 234 and is pivotally attached at its base to the arm platform 168. As illustrated in FIG. 6, one or more actuators (a "tilt actuator 237") are connected between the top of the pin 236 and the advance platform 168 to pivot the lower spherical bearing housing 224 and, consequently, pivot or tilt the arm 30. An identical lever and pin attached to the advance platform 168 are also attached to the opposite side of the lower spherical bearing housing 224, which provides a fixed pivot point for the pivot assembly 204. In some embodiments, the tilt actuator 237 can tilt the arm 30 approximately 1.5 degrees up and down from a level horizontal position of the arm 30.

Therefore, in some embodiments, the mining machine 10 includes multiple actuators for positioning and moving the arm 30. In particular, the swing actuators 160 and 164 are used for arm 30 slew or swing, the advance actuators 171 and 172 are used for arm 30 extension and retraction, and the tilt actuator 237 is used for arm 30 tilt or elevation. In should be understood that additional or fewer actuators may be used to perform particular movement of the arm 30. When the actuators include one or more hydraulic actuators, each hydraulic actuator can be equipped with linear variable differential transducers ("LVDT") or other sensors that provide actuator stroke position signals and pressure transmitters. Each hydraulic actuator can also be equipped with either proportional valves or a load holding valve to lock the actuator in position when not actuated. When other types of actuators are used besides hydraulic actuators, the actuators can include sensors and mechanisms for providing similar information about the state of the actuator and for locking the actuator in a particular position.

The mining machine 10 also includes a control system that controls operation of the mining machine 10. As described in more details below, the control system performs some operations of the mining machine 10 automatically without requiring manual interaction. In general, the control system can initiate an automated sequence automatically or in response to a manual command (e.g., from a remote control unit operated by an operator). After the automated operation is initiated, the control system performs the automated sequence without requiring manual interaction.

Figure 8:
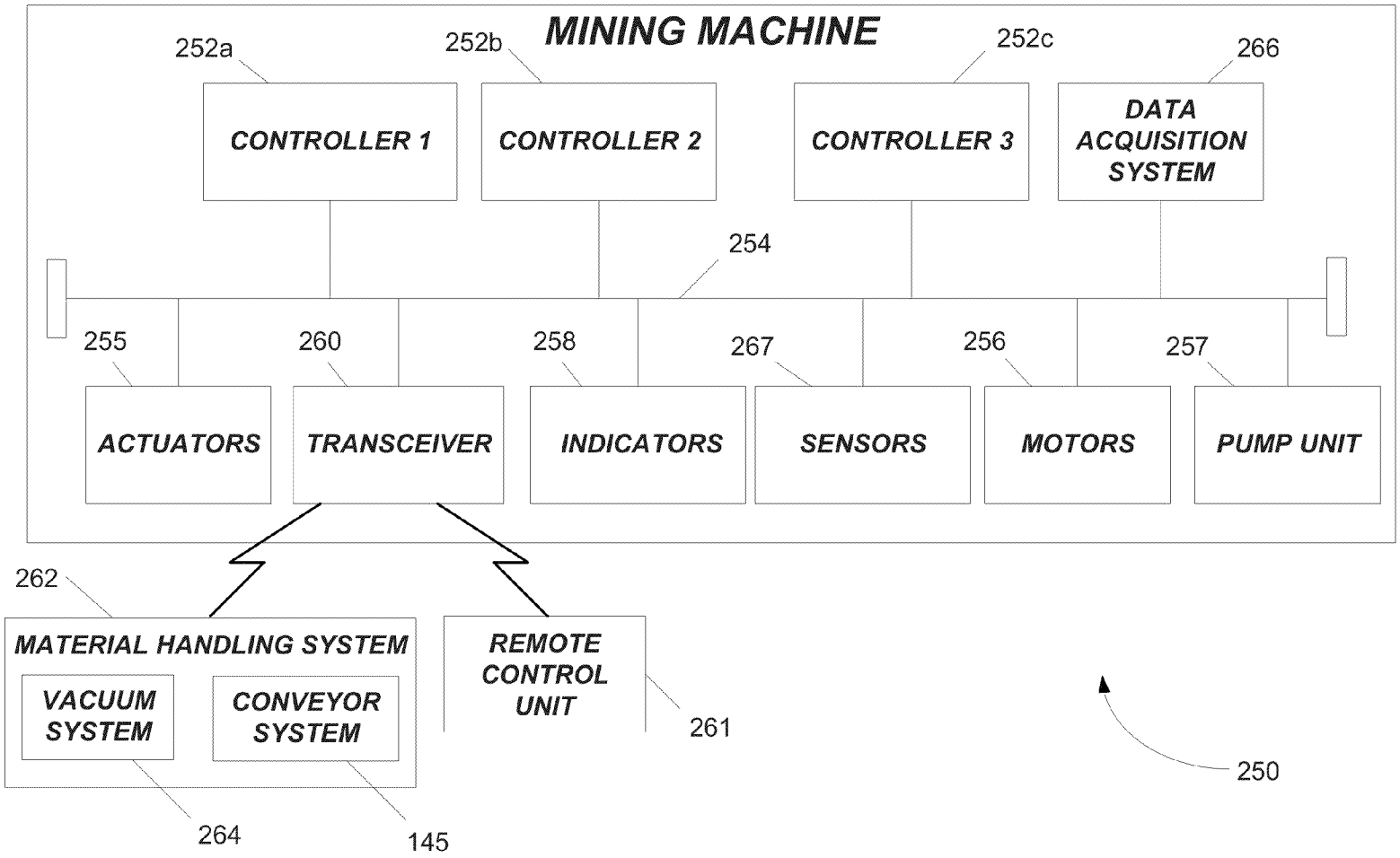
FIG. 8 schematically illustrates a control system of the mining machine of FIG. 1.

FIG. 8 schematically illustrates a control system 250 of the mining machine 10 according to one embodiment of the invention. As illustrated in FIG. 8, the system 250 includes at least one controller 252. In particular, the control system 250 includes first controller 252*a* (i.e., "controller 1"), a second controller 252*b* (i.e., "controller 2"), and a third controller 252*c* (i.e., "controller 3").

In some embodiments, the first controller 252*a* controls tramming of the machine 10 using the tracks 24 and controls the stabilization system 25. The first controller 252*a* can also control communication with a remote control unit. In addition, in some embodiments, the first controller 252*a* controls one or more pumps that drive at least some of the actuators and/or motors included in the mining machine 10. The second controller 252*b* can control the disc cutter assemblies 66 (e.g., cutter motors) and the movement of the arm 30 (e.g., the swing actuators 160 and 164, the advance actuators 171 and 172, and the tilt actuator 237). The second controller 252*b* can also control indicators located on or off of the machine 10 that provide information (e.g., visually, audibly, etc.) to operators and other personnel. In addition, the second controller 252*b* can control the vacuum system and can communicate with the remote control unit and other external systems and devices. In some embodiments, the third controller 252*c* controls communication between the mining machine 10 and external devices and systems (e.g., machine input/output extension). It should be understood that the functionality performed by the controllers 252 can be combined in a single controller or distributed among additional controllers. Similarly, the control system 250 can include additional controllers 252 located external to the mining machine 10. The three controllers 252 illustrated in FIG. 8 and their associated functionality are provided as one example configuration of the system 250.

The controllers 252 communicate over a system bus 254. As illustrated in FIG. 8, other components of the mining machine 10 are also connected to and communicate over the bus 254. In particular, actuators 255 included in the machine 10 are connected to the bus 254 and can communicate with (e.g., receive commands from and provide information to) the controllers 252. The actuators 255 can include the actuators 136 for moving the forward and/or rearward platforms 128 and 130, the swing actuators 160 and 164, the advance actuators 171 and 172, and the tilt actuator 237. In some embodiments, the controllers 252 send operational commands to the actuators 255 and can receive position and pressure information from the actuators 255 (e.g., from the LVDT associated with each actuator 255) over the bus 254.

Motors 256 that drive the disc cutter assemblies 66 (i.e., "cutter motors") and/or the tracks 24 are also connected to the bus 254 and communicate with the controllers 252. In addition, a pump unit 257 is connected to the bus 254 and communicates with the controllers 252. As described in more detail below, the pump unit 257 provides oil to at least some of the actuators and motors in the mining machine 10. In particular, the pump unit 257 can include a triple main pump unit that controls the motors and actuators associated with moving the tracks 24 and the arm 30 (e.g., the swing actuators 160 and 164, the advance actuators 171 and 172, and the tilt actuator 237). In some embodiments, the pump unit 257 also controls a water pump and supplies hydrostatic bearing oil to the disc cutter assemblies 66. Furthermore, in some embodiments, the pump unit 257 controls various actuators and actuators included in the stabilization system 25.

The controllers 252 can also communicate with various machine indicators 258, such as lights, audible alarms, and associated displays, included in the mining machine 10. The indicators 258 are used to convey information to operators and personnel. The mining machine 10 can also include a transceiver 260 that allows the mining machine 10 to send and receive data (e.g., commands, records, operating parameters, etc.) to and from components external to the mining machine 10. For example, the controllers 252 can use the receiver 260 to communicate with a remote control unit 261 (e.g., a hand-held remote control) and other external monitoring or control systems, such as a supervisory control and data acquisition ("SCADA") system. In particular, in some embodiments, an operator can issue commands to the mining machine 10 using the remote control unit 261. The remote control unit 261 can include a radio transmitter, an umbilical cable connector, or both. The remote control unit 261 allows an operator to initiate various operations of the mining machine 10, such as turning the machine 10 on and off, stopping the machine 10, starting and stopping various components and systems of the machine 10, stabilizing the machine 10, initiating automated operations, initiating manual operations, and shutting down the machine 10. The controllers 252 can also use the transceiver 260 to communicate with a material handling system 262 that includes a vacuum system 264 and the conveyor system 145.

As illustrated in FIG. 8, a data acquisition system 266 can also be connected to the bus 254 and can acquire and log machine operational data in a computer-readable medium. The computer-readable medium can be removable or transferable to allow data to be viewed on a personal computer (e.g., a laptop, PDA, smart phone, tablet computer, etc.). The data acquisition system 266 can also be configured to transmit data over a network connection (e.g., an Ethernet connection), a cable (e.g., a universal serial bus ("USB") cable), or another type of wired or wired connection. In some embodiments, the data acquisition system 266 automatically starts acquiring data when cutting is performed with the mining machine 10 and automatically stops acquiring data when the cutting stops.

In addition, the controllers 252 can communicate with other systems, sensors, and components of the mining machine 10 for monitoring purposes and/or control purposes. For example, as illustrated in FIG. 8, the controllers 252 can communicate with a plurality of sensors 267 that provide information regarding operation of the machine 10. The sensors 267 can include motor current sensors, temperature sensors, relay sensors, oil sensors, position sensors, pressure sensors, etc. The sensors 267 provide information regarding oil temperature, actuator position, bearing oil pressure, detected water, etc. As described in more detail below, the controllers 252 use the information from the sensors 267 to automatically operate the machine 10.

Figure 9B:
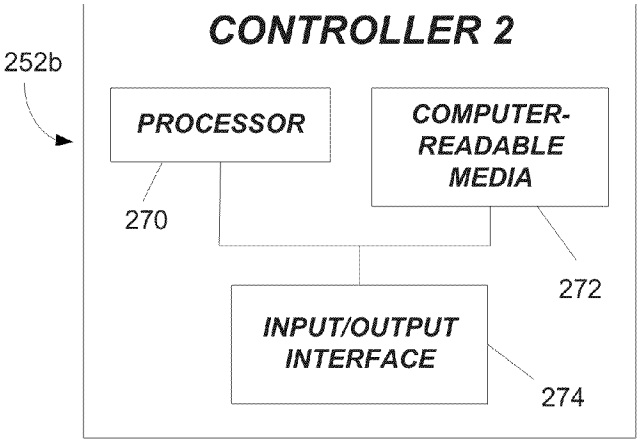
FIGS. 9*a-c* schematically illustrate at least one controller of the control system of FIG. 8.
Figure 9A:
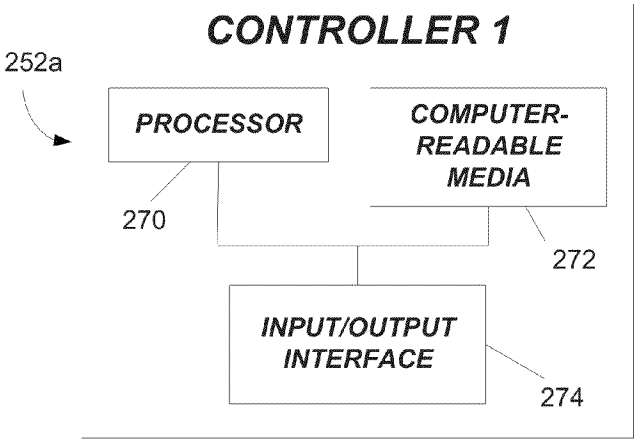
Figure 9C:
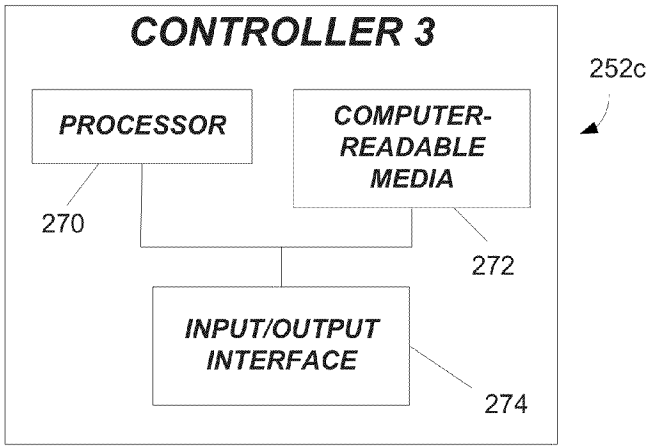

FIGS. 9*a-c* schematically illustrate the controllers 252. As illustrated in FIGS. 9*a-c*, each controller 252 includes a processor 270, computer-readable media 272, and an input/output interface 274. It should be understood that in some embodiments the controllers 252 includes multiple processors 270, computer-readable media modules 272, and/or input/output interfaces 274. Also, in some embodiments, the components of each of the controllers 252 differ (e.g., controller 1 includes additional components as compared to controller 2). In some embodiments, each controller 252 is enclosed in a robust, dustproof enclosure.

The processor 270 retrieves and executes instructions stored in the computer-readable media 272. The processor 270 also stores data to the computer-readable media 272. The computer-readable media 272 includes non-transitory computer readable medium and includes volatile memory, non-volatile memory (e.g., flash memory), or a combination thereof. The input/output interface 274 receives information from outside the controller 252 (e.g., from the bus 254) and outputs information outside the controller 252 (e.g., to the bus 254). In some embodiments, the input/output interface 274 also stores data received from outside the controller 252 to the computer-readable media 272 and, similarly, retrieves data from the computer-readable media 272 to output outside the controller 252.

The instructions stored in the computer-readable media 272 of each controller 252 perform particular functionality when executed by the processor 270. For example, as described in more detail below, the controllers 252 execute instructions to perform various automated operations of the mining machine. In particular, as described in more detail below, the controllers 252 can control the mining machine to automatically (i.e., without requiring manual interaction from an operator) perform pre-tramming operations, find-face operations, cutting operations, stop-cutting operations, and shutdown operations. As part of these operations, the controllers 252 automatically operate the actuators 255, the motors 256, the pump unit 257, the transceiver 260, the indicators 258, and other components and systems associated with the mining machine 10. The controllers 252 can also communicate with the material handing system 262, a water supply system, and an electrical system associated with the mining machine 10 during these automated operations.

Machine Operation

To start the machine 10, an operator switches on a power supply breaker. The operator or engineer then checks various operational parameters of the machine 10 (e.g., using the SCADA system). The operational parameters can include a tilt speed, advance and retract speeds, a swing speed, a depth of the cut, a maximum arm swing angle, a tilt incremental adjustment, automatic cutting parameters, and cutting and swinging positions. After checking the parameters, the operator can activate the remote control unit 261 and initiate a command with the remote control unit 261 to start the pump unit 257. In some embodiments, an alarm is sounded for approximately 10 seconds before the pump 257 is started to alert personnel that the machine 10 is being started. In some embodiments, the control system 250 also verifies that circuit interlocks associated with the pump unit 257 are operational before the pump 257 is started. If circuit interlocks are operational, the control system 250 starts the motor associated with the pump unit 257. With the pump unit 257 running, the operator can tram, tilt, and swing the machine 10 to a desired position using the remote control unit 261.

Pre-Tramming

Figure 10A:
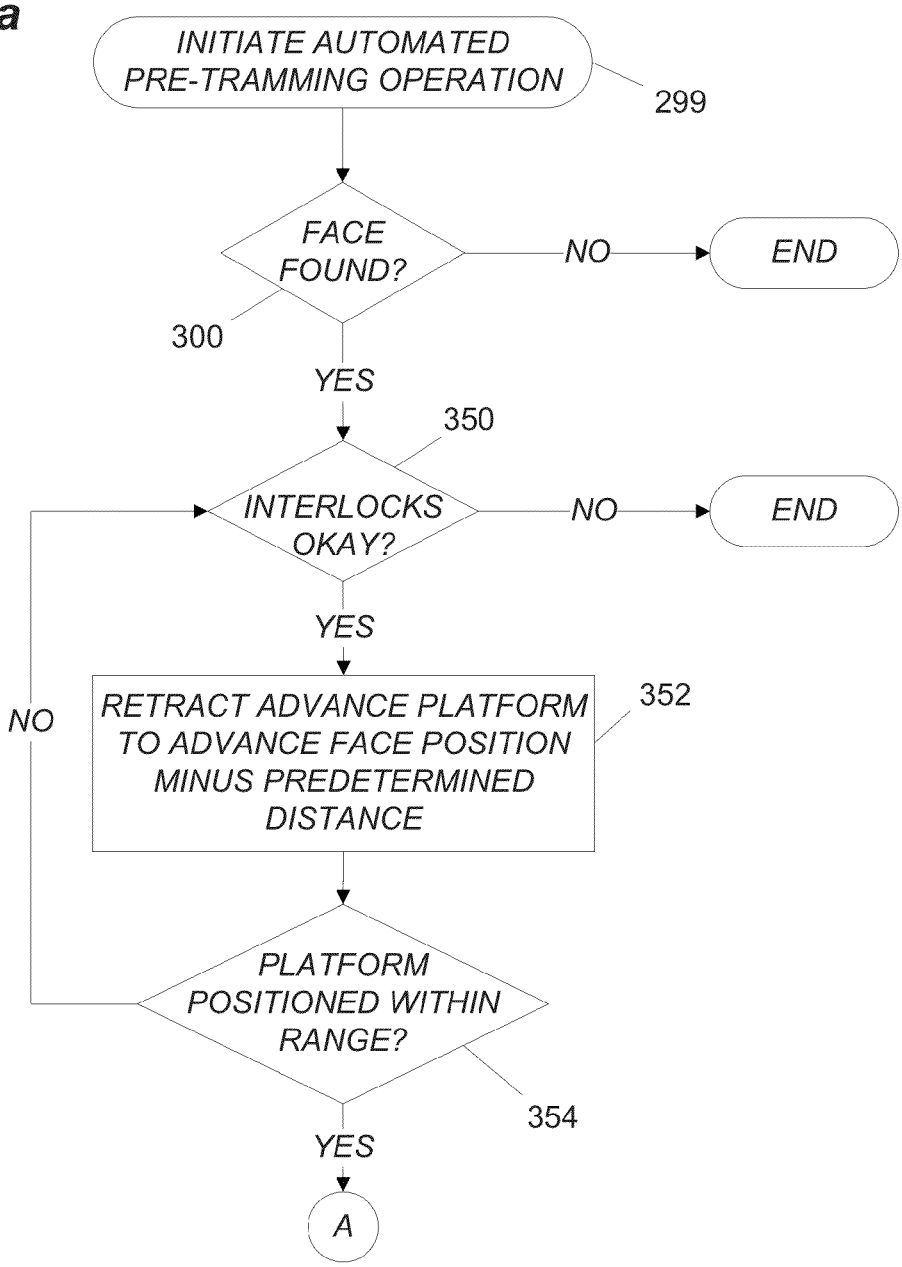
FIGS. 10*a-b* are flow charts illustrating an automated pre-tramming operation performed by the control system of FIG. 8.
Figure 10B:
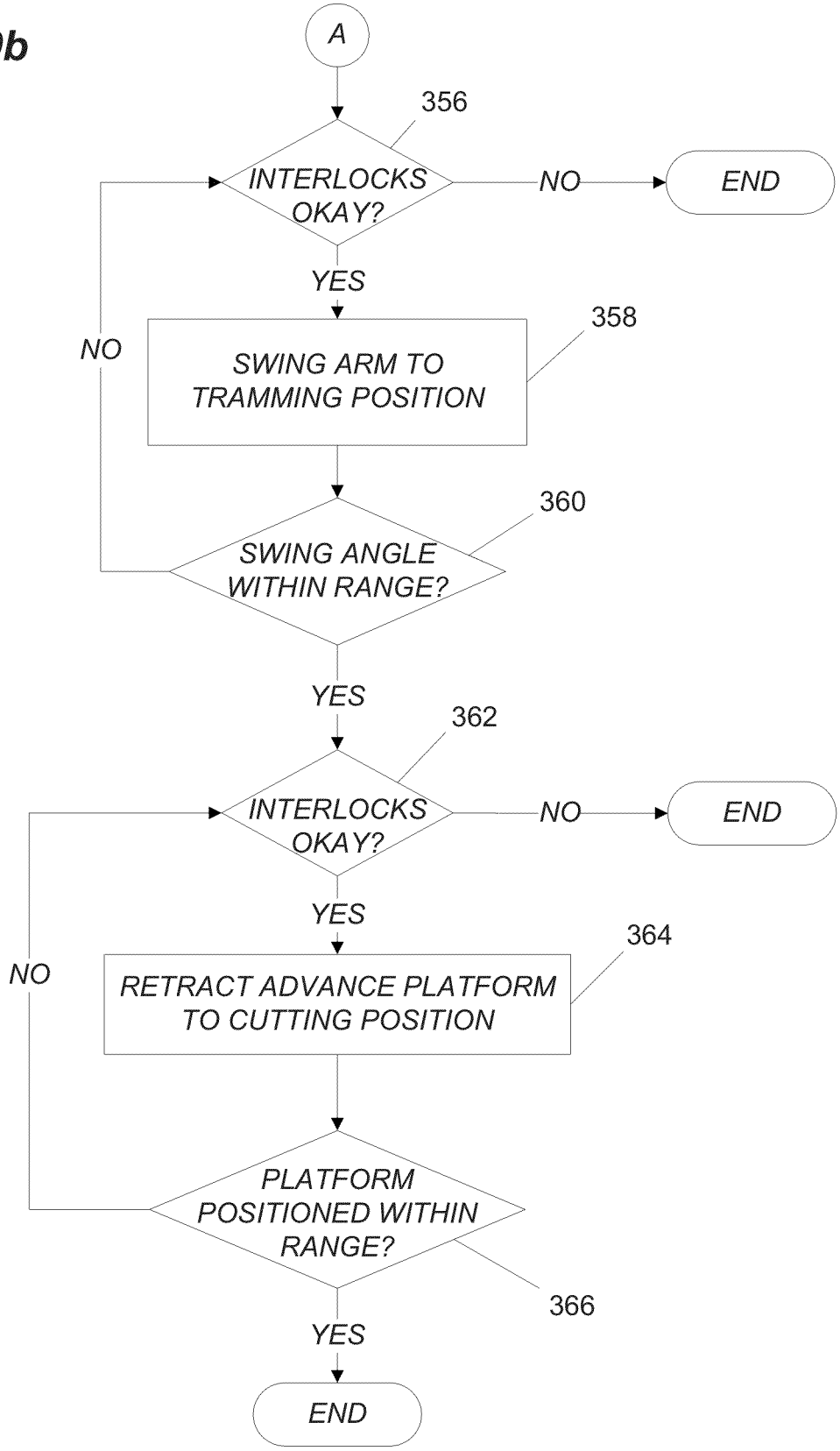

After the machine 10 is started but before the machine 10 is trammed, the arm 30 is positioned at a predetermined tramming position to safely tram the machine 10. This operation is commonly referred to as "pre-tramming." The control system 250 can automatically perform pre-tramming. In particular, as noted above with respect to FIGS. 9*a-c*, the controllers 252 include software stored in the computer-readable media 272 and executable by a processor 270 to perform various automated operations of the mining machine 10. In some embodiments, the software includes instructions for performing an automated pre-tramming operation. FIGS. 10*a-b* illustrate additional details of the automated pre-tramming operation.

The automated pre-tramming operation can be initiated manually or automatically. To manually initiate the operation, the operator can select a pre-tramming function or button from the remote control unit 261, and the remote control unit 261 can send an "initiate" command to the control system 250. As described below, the control system 250 can also automatically initiate the automated pre-tramming operation during an automated cutting operation (see FIG. 12*f*).

After the automated pre-tramming operation is initiated (at 299), the control system 250 performs the automated operation without requiring manual interaction. In particular, as illustrated in FIG. 10*a*, the control system 250 determines if the cutting face has been located (at 300). This operation is commonly referred to as the "find-face" operation and can include aligning the platform 168 and the arm 30 with the cutting face. The coordinates of the cutting face can then be determined based on the position (e.g., extension, angle, and tilt) of the aligned platform 168 and arm 30.

Find-Face

Figure 11A:
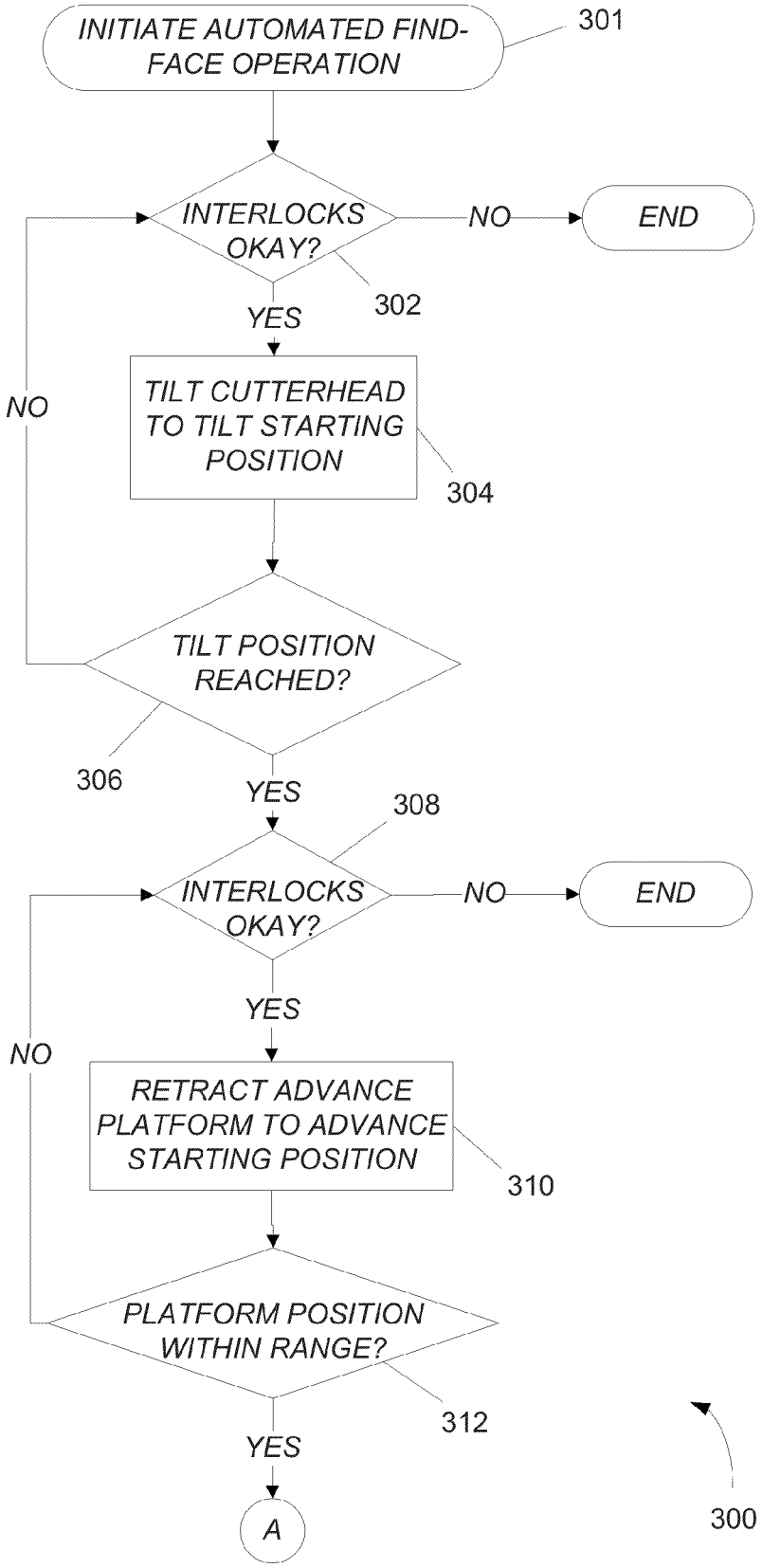
FIGS. 11*a-c* are flow charts illustrating an automated find-face operation performed by the control system of FIG. 8.
Figure 11B:
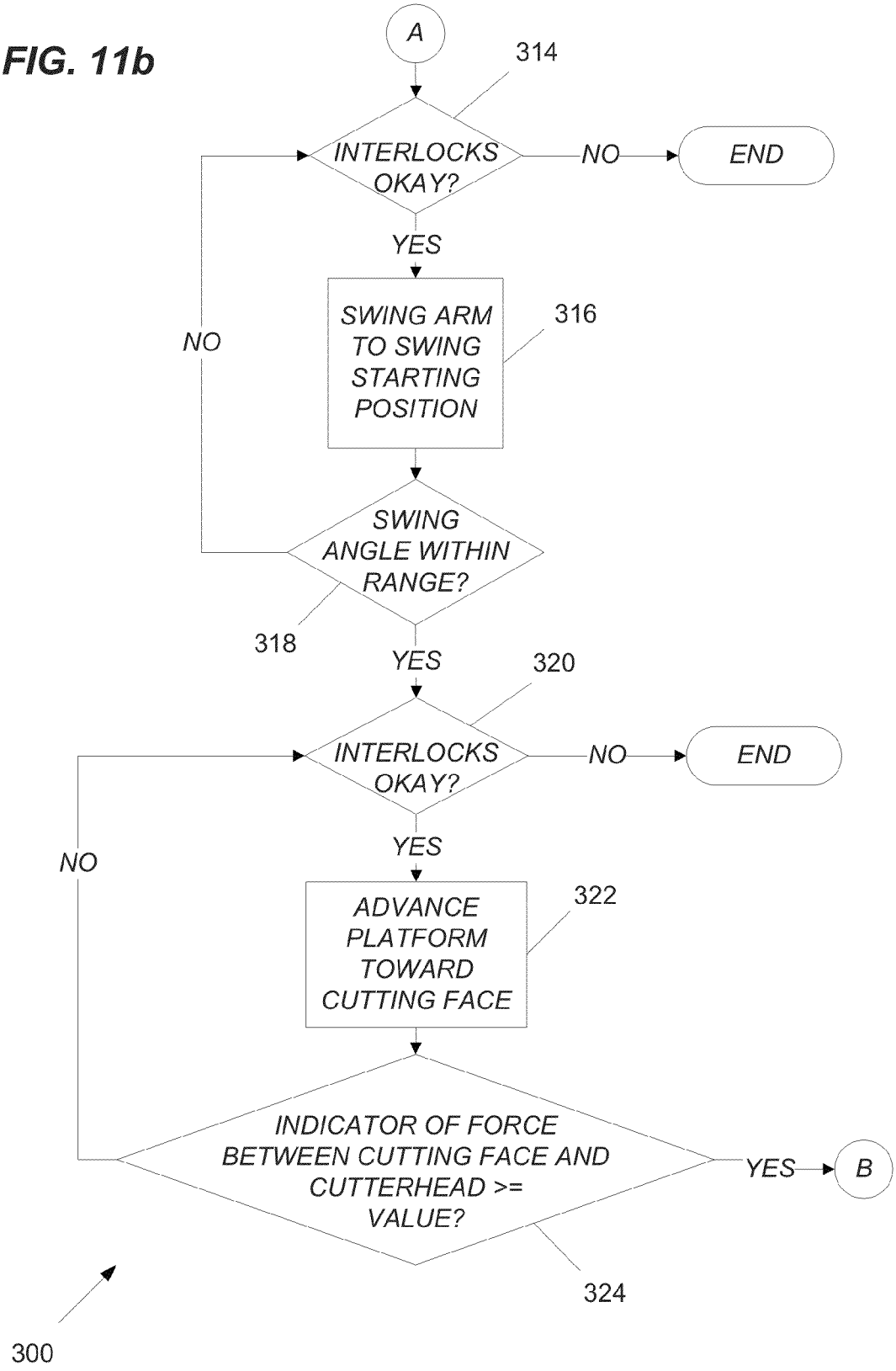
Figure 11C:
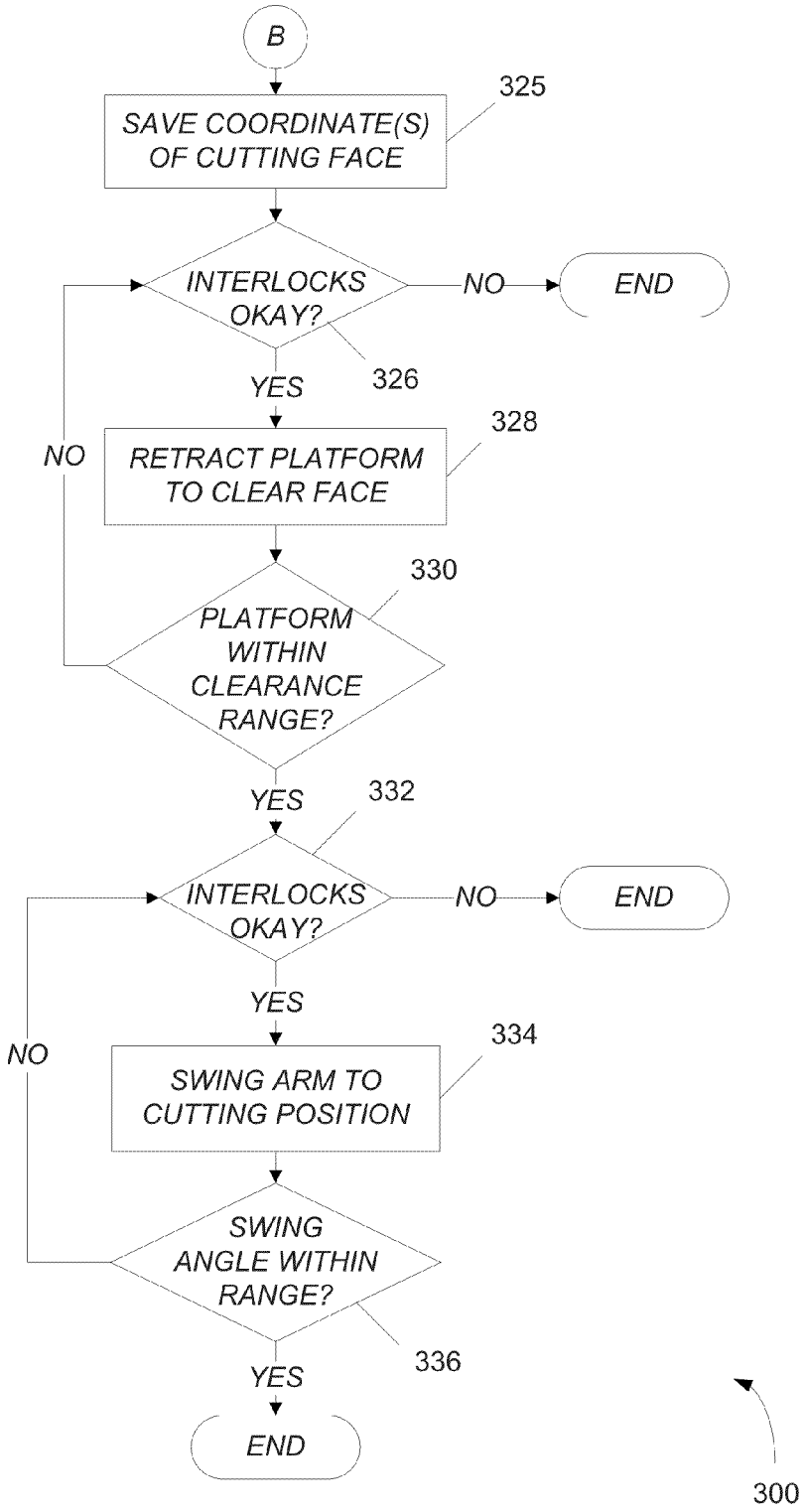

The control system 250 can perform an automated find-face operation. In particular, as noted above with respect to FIGS. 9*a-c*, the controllers 252 include software stored in the computer-readable media 272 and executable by a processor 270 to perform various automated operations of the mining machine 10. In some embodiments, the software includes instructions for performing an automated find-face operation. To initiate the automated find-face operation, the operator can select a find-face function or button from the remote control unit 261, and the remote control unit 261 can send an "initiate" command to the control system 250. Also, in some embodiments, the control system 250 automatically initiates the find-face operation. For example, the control system 250 can automatically initiate the automated find-face operation as part of the automated pre-tramming operation if the cutting face has not already been located (at 300, see FIG. 10*a*). FIGS. 11*a-c* illustrate additional details of the automated find-face operation.

After the automated find-face operation is initiated (at 301), the control system 250 performs the operation without requiring manual interaction. In particular, as illustrated in FIG. 11*a*, the control system determines if machine interlocks have been tripped or set (at 302). If the interlocks have been tripped or set (i.e., are not "okay") at any time during the find-face operation, the control system 250 ends the automated find-face operation. If the interlocks have not been tripped or set (i.e., are "okay") (at 302), the control system 250 positions the advance platform 168 and the arm 30 at a predetermined starting position. The predetermined starting position can include an advance starting position and a swing starting position. In some embodiments, the predetermined starting position also includes a tilt starting position.

In particular, as illustrated in FIG. 11*a*, if the interlocks are okay (at 302), the control system 250 automatically operates the tilt actuator 237 to tilt the arm 30 to the tilt starting position (at 304). The tilt or vertical elevation of the arm 30 helps the mining machine 10 cut along the band or reef by aligning the cutter disc assemblies 66 with the reef. Therefore, the arm's vertical position should be maintained from one cut to another to ensure efficient cutting. In some embodiments, the tilt starting position is approximately 135 millimeters, but this value can change based on the profile of the particular reef being cut and other parameters of the mining machine 10. The tilt starting position can be specified as an angle from a default vertical position of the arm 30, as millimeters representing an extension of the tilt actuator 237, or as a vertical displacement from a default vertical position of the arm 30. In some embodiments, the tilt starting position is the same as a tilt cutting position described below with respect to the automated cutting operation (see FIGS. 12*a*-12*g*).

When the arm 30 reaches the tilt starting position and while the interlocks remain okay (at 302 and 308), the control system 250 automatically operates the advance actuators 171 and 172 to move the advance platform 168 to the advance starting position (at 310). In some embodiments, the advance starting position is a minimum stroke or extension of the advance actuators 171 and 172 at which cutting can occur (e.g., 1100 millimeters). The advance starting position can be the same as an advance cutting position described below with respect to the automated cutting operation (see FIGS. 12*a*-12*g*).

When the platform 168 is within range of the advance starting position (e.g., extended from approximately 1097 millimeters to approximately 1103 millimeters) (at 312) and while the interlocks remain okay (at 308 and 314, see FIG. 11*b*), the control system 250 automatically operates the swing actuators 160 and 164 to swing the arm 30 to the swing starting position (at 316). In some embodiments, the swing starting position is approximately 90 degrees (i.e., approximately parallel to the longitudinal axis 25 of the frame 12 of the mining machine 10), which is the swing angle at which a depth of a cut is maximized. In other embodiments, the swing starting position is the same as a swing cutting position described below with respect to the automated cutting operation (see FIGS. 12*a*-12*g*).

When the arm 30 is within range of the swing starting position (e.g., within approximately 1 degree of the swing starting position) (at 318) and while the interlocks remain okay (at 314 and 320), the control system 250 finds the cutting face relative to the predetermined starting position. In particular, the control system 250 automatically operates the advance actuators 171 and 172 to advance the platform 168 (e.g., at a set speed) until one of the disc cutter assemblies 66 touches (i.e., "finds") the cutting face (at 322). In particular, the control system 250 operates the advance actuators 171 and 172 to advance the cutterhead 26 toward the cutting face until the center disc cutter assembly 66*a* makes contact with the cutting face. The control system 250 also continues to advance the platform 168 (and subsequently the cutterhead 26) toward the cutting face until a physical force between the cutterhead 26 and the cutting face exceeds a predetermined threshold. When the physical force reaches or exceeds the predetermined threshold, the cutterhead 26 is properly positioned against the cutting face to determine at least one coordinate of the cutting face based on the positions of the arm 30 and/or the platform 168.

In some embodiments, the control system 250 indirectly measures the physical force between the cutterhead 26 and the cutting face. In particular, parameters of the advance actuators 171 and 172 can provide one or more indicators of the physical force between the cutterhead 26 and the cutting face. The control system 250 can determine if these indicators equal or exceed a predetermined value to indirectly determine if the physical force between the cutterhead 26 and the cutting face has reached the predetermined threshold. For example, if the advance actuators 171 and 172 include hydraulic cylinders, the control system 250 can use a pressure value of the actuators 171 and 172 as an indicator of the physical force between the cutterhead 26 and the cutting face. In particular, the control system 250 can advance the platform 168 toward the cutting face until the advance actuators 171 and 172 are pressurized to a predetermined pressure value (e.g., 120 bar). The control system 250 can use a similar pressure value as an indicator of the physical force between the cutterhead 26 and the cutting face when the actuators 171 and 172 include pneumatic actuators. In other embodiments, the control system 250 can use parameters of a current supplied to the actuators 171 and 172, a force value between components of the actuators 171 and 172, or a physical position of a component of the actuators 171 and 172 as the indicator of the physical force between the cutterhead 26 and the cutting face. Other components of the machine 10, such as the swing actuator 160 and 164, the tilt cylinder 237, and the sensors 267, can also provide one or more indicators of the physical force between the cutterhead 26 and the cutting face.

When the indicator of the physical force between the cutterhead 26 and the cutting face equals or exceeds the predetermined value (at 324), the control system 250 saves at least one coordinate of the cutting face based on the current positions of the tilt actuator 237, the advance actuators 171 and 172, and/or the swing actuators 160 and 164 (e.g., to a computer-readable medium of one of the controllers 252) (at 325). In some embodiments, the coordinates include an advance face position, a swing face position, and a tilt face position. The advance face position is based on a position of the advance platform 168, the swing face position is based on an angle of the arm 30, and the tilt face position is based on a tilt of the arm 30. In particular, the advance face position can be based on an extension or stroke of the advance actuators 171 and 172. Similarly, the swing face position can be based on an extension or stroke of the swing actuators 160 and 164, and the tilt face position can be based on an extension or stroke of the tilt actuator 237. Accordingly, the coordinates of the cutting face can be specified in terms of the stroke of the advance actuators 171 and 172, the angle of the arm 30, and the stroke of the tilt actuator 237 when the center disc cutter assembly 66*a* is touching the cutting face.

After saving the coordinates of the cutting face (at 325) and while the interlocks remain okay (at 326), the control system 250 automatically operates the advance actuators 171 and 172 to retract the advance platform 168 from the identified cutting face by a predetermined retract distance (e.g., to prevent the disc cutter assemblies 66 from dragging against the face when the arm 30 swings) (at 328). In some embodiments, the retract distance is from approximately 20 millimeters to approximately 35 millimeters. When the advance platform 168 is within range of the retract distance (e.g., within approximately 2 millimeters from the retract distance) (at 330) and while the interlocks remain okay (at 332), the control system 250 automatically operates the swing actuators 160 and 164 to swing the arm 30 to a predetermined swing cutting position (e.g., at a predetermined swing speed) (at 334). The swing cutting position can be an angle of the arm 30 at which all cuts performed by the mining machine 10 start. When the arm 30 is within range of the swing cutting position (e.g., within 1 degree of the swing cutting position) (at 336), the find-face operation ends.

After the coordinates of the cutting face are saved, the control system 250 (and/or other control systems included in or external to the mining machine 10) can access the coordinates from the computer-readable medium. For example, the control system 250 can access the coordinates when starting a new cut of the cutting face and when pre-tramming the machine 10. The control system 250 can also access the saved coordinates if they are lost (e.g., during a power failure occurring during a cut). As described below in more detail, after performing a cut, the control system 250 also updates the saved coordinates of the cutting face to account for the depth of the cut.

In some embodiments, the control system 250 can designate saved coordinates as either coordinates found manually or automatically. For example, the control system 250 can separately save manually-found coordinates and automatically-found coordinates. In addition, if a manual find-face operation is performed, the control system 250 can save the manually-found find-face coordinates and can reset the automatically-found coordinates (e.g., by setting the automatically-found coordinates to zero or another default or invalid value) and vice versa. Resetting the automatically-found coordinates when a manual find-face operation is performed and vice versa prevents the control system 250 from using invalid coordinates for the cutting face.

Returning to FIG. 10*a* and the automated pre-tramming operation, when the cutting face has been located (at 300), the control system 250 determines if the interlocks are okay (at 350). If the interlocks are not okay at any time during the automated pre-tramming operation, the control system 250 ends the automated pre-tramming operation. If the interlocks are okay, the control system 250 automatically operates the advance actuators 171 and 172 to retract the advance platform 168 to a predetermined clearance distance. The clearance distance can be approximately 50 millimeters from the cutting face. For example, the control system 250 can access the stored coordinates of the cutting face and can retract the advance platform 158 the predetermined clearance distance based on the accessed coordinates. In particular, the control system 250 can retract the advance platform 168 approximately 50 millimeters from the saved advance face position. Retracting the platform 168 to the clearance distance prevents the disc cutter assemblies 66 from contacting and dragging on the cutting face when the arm 30 swings during pre-tramming.

When the advance platform 168 reaches the clearance distance (e.g., is within approximately 2 millimeters of the clearance distance) (at 354) and while the interlocks remain okay (at 350 and 356, see FIG. 10*b*), the control system 250 swings the arm 30 to a predetermined tramming position (at 358). In some embodiments, the tramming position is approximately 90 degrees. However, the tramming position can be set to any angle that prevents the cutterhead 26 from dragging on the cutting face when the machine 10 is trammed. The tramming position can also be selected to help move the mining machine's center of gravity as far back as possible, which helps stabilize the machine 10 during tramming.

When the arm 30 reaches the tramming position and the interlocks remain okay (at 356 and 362), the control system 250 automatically operates the advance actuators 171 and 172 to retract the advance platform 168 to a predetermined advance cutting position (at 364). In some embodiments, the advance cutting position is the minimum extension of the advance actuators 171 and 172 at which cutting can start (e.g., from approximately 1097 millimeters to approximately 1103 millimeters). When the advance platform 168 is within range of the advance cutting position (e.g., is at or exceeds the advance cutting position) (at 366), the automated pre-tramming operation ends.

After the machine 10 has been pre-trammed, the machine 10 can be safely trammed (e.g., to a starting position for cutting). To tram the machine 10 forward or in reverse, an operator can press one or a combination of buttons and actuate a joystick on the remote control unit 261 in a desired direction (i.e., to issue a "tram-forward" or a "tram-reverse" command). When an operator issues a tram-forward or a tram-reverse command, the brakes for the tracks 24 are released and motors drive the tracks 24 in the commanded direction. The control system 250 matches the drive speed of the tracks 24 to prevent unintended slewing of the machine 10 and to accurately direct the machine 10. In some embodiments, if the speed difference between the two tracks 24 is greater than a predetermined value for a predetermined time, the control system 250 automatically disables tramming.

In some embodiments, the machine 10 can be equipped with a laser displacement sensor configured to measure how far the cutterhead 26 is from the cutting face. If the machine 10 is trammed too close to the cutting face, the control system 250 automatically disables horizontal swinging of the arm 30 to prevent damage to the disc cutter assemblies 66. Also, in some embodiments, when an operator is tramming the machine 10 toward the cutting face, the control system 250 can automatically disable tranmming if the machine 10 (e.g., the cutterhead 26) comes within a predetermined minimum distance of the cutting face.

In some embodiments, the control system 250 is also configured to perform automated tramming (i.e., "auto-tram" or "auto-tramming") and an operator can enable or disable the auto-tramming functionality. In some embodiments, an operator enables auto-tramming to allow the control system 250 to automatically tram the machine 10 when the advance actuators 171 and 172 reach a predetermined maximum extension during an automated cutting operation. When the auto-tramming functionality is activated, the control system 250 trams the machine 10 forward at a predetermined tramming speed for a predetermined tramming distance and then automatically stops. In some embodiments, after auto-tramming, the machine 10 is stabilized (e.g., manually or automatically) before cutting is resumed.

Cutting

After the machine 10 has been trammed (e.g., to a starting position), the control system 250 can perform an automated cutting operation (i.e., "auto-cutting"). In particular, as noted above with respect to FIGS. 9*a-c*, the controllers 252 include software stored in the computer-readable media 272 and executable by a processor 270 to perform various automated operations of the mining machine 10. In some embodiments, the software includes instructions for performing an automated cutting operation. Automating the cutting cycle requires minimal operator interaction and reduces risks associated with mining activities. During the automated cutting operation, the machine 10 operates autonomously under control of the control system 250 and does not require manual interaction. The control system 250, however, may receive commands and data (e.g., wirelessly) from the remote control unit 261 or a remote operator station (e.g., the SCADA) that stops or overrides the automated cutting operation. The control system 250 also receives data (e.g., over the bus 254) that the control system 250 uses to adjust or terminate the automated cutting sequence based on current operating parameters of the mining machine 10. In particular, in some embodiments, the control system 250 continuously monitors operational parameters of the machine 10 and shuts down or aborts the automated cutting operation in the event of a system failure or if operational parameters are outside of set limits. Also, the control system 20 may only allow cutting if the machine 10 has been stabilized (e.g., using the stabilization system 25) and the cutting face has been found (see find-face operation described above with respect to FIGS. 11*a-c*). Furthermore, the control system 250 aborts the automated cutting operation if an operator issues an abort command from the remote control unit 261.

To manually initiate the automated cutting operation, the operator can select a start-cutting function or button from the remote control unit 261, and the remote control unit 261 can send an "initiate" command to the control system 250. In some embodiments, when the operator selects the start-cutting function, the data acquisition system 266 automatically starts (e.g., based on a command from the remote control unit 261 and/or the control system 250) to monitor and record the cutting operation. In some embodiments, the control system 250 can also automatically initiate the automated cutting operation (e.g., after automatically tramming the machine 10 to reposition the machine 10 for a new cutting sequence). FIGS. 12*a-g* illustrate additional details of the automated cutting operation.

Figure 12A:
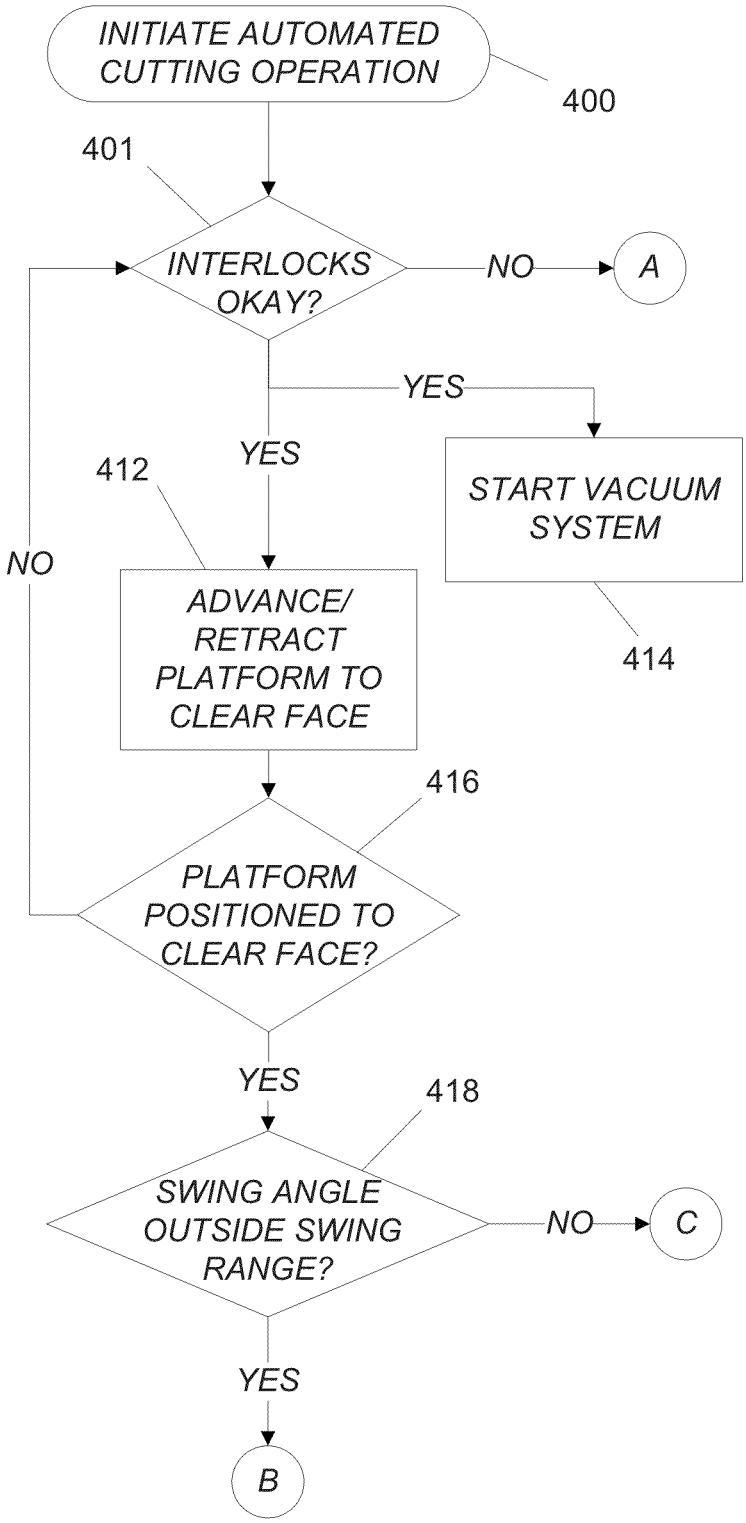
FIGS. 12*a-g* are flow charts illustrating an automated cutting operation performed by the control system of FIG. 8.
Figure 12B:
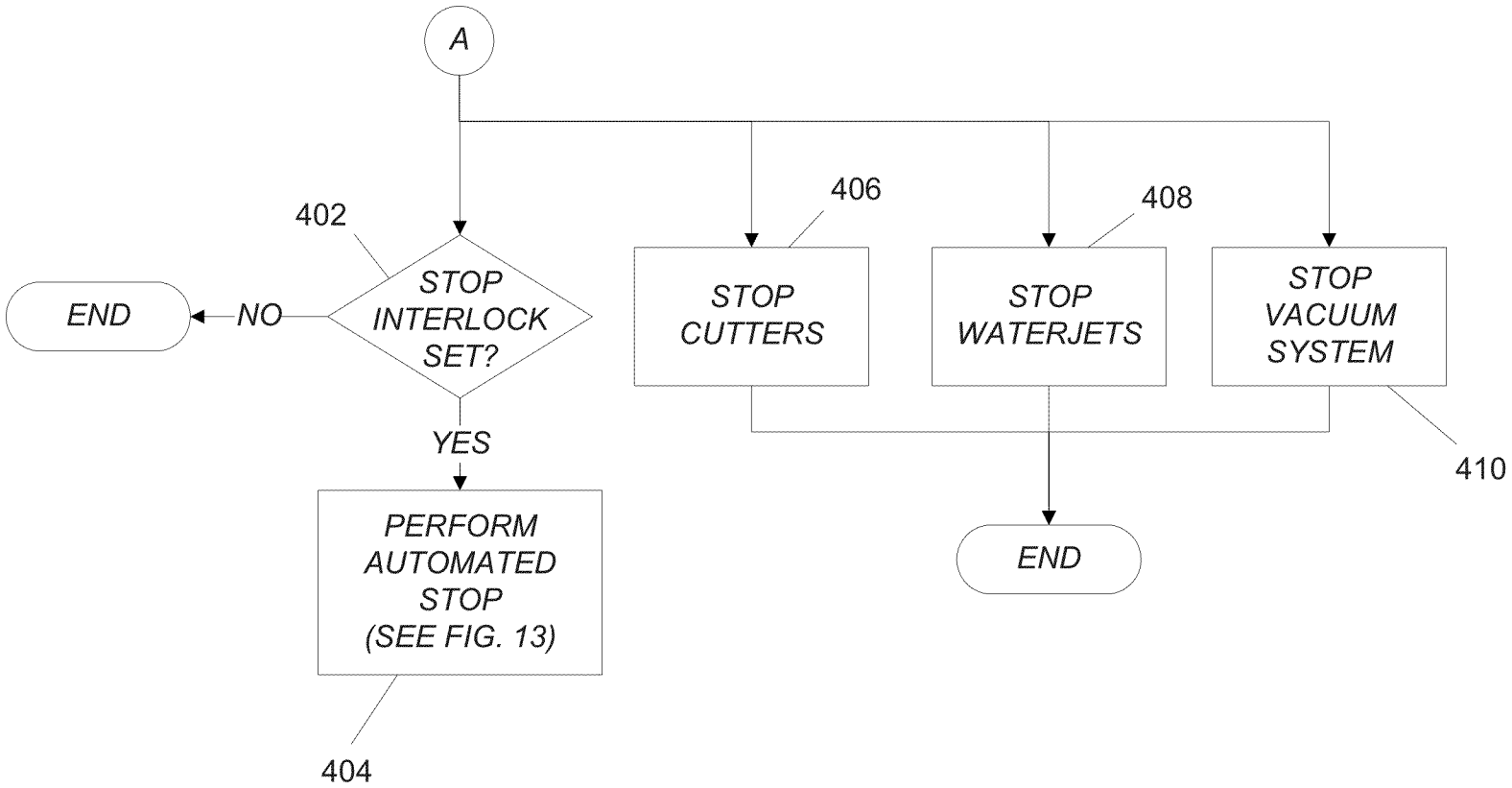

As illustrated in FIG. 12*a*, after the automated cutting operation is initiated (at 400), the control system 250 (e.g., the second controller 252*b*) determines if the interlocks are okay (at 401). If the interlocks are not okay at any time during the automated cutting operation, the control system 250 ends the automated cutting operation as illustrated in FIG. 12*b*. In particular, to end the automated cutting operation, the control system 250 determines if the stop interlock has been set (at 402). In some embodiments, the stop interlock is set when cutting has started but a subsequent machine condition indicates that cutting should be stopped or aborted. Therefore, if the stop interlock has been set, the control system 250 can execute or perform an automated "stop-cutting" operation (at 404) to ensure that the automated cutting operation is properly and safely stopped. Additional details regarding the automated stop-cutting operation are provided below with respect to FIG. 13.

As illustrated in FIG. 12*b*, in addition to checking if the stop interlock is set (at 402), the control system 250 also stops the disc cutter assemblies 66 (e.g., the associated cutter motors) (at 406), stops the water jets 99 on each disc cutter assembly 66 (at 408), and stops the vacuum system 264 and other components of the material handling system 262 (at 410). It should be understood that depending on the state of the automated cutting operation when it is stopped or aborted, not all of these components of the machine 10 may be operating. Therefore, FIG. 12*b* illustrates components that can be stopped as necessary when stopping the automated cutting operation.

In some embodiments, the control system 250 immediately stops the cutter motors, the water jets 99, and the pump unit 257 when stopping the automated cutting operation. However, in some embodiments, the control system delays shutdown of the vacuum system 264 and other components of the material handling system 262 to allow material in the vacuum and conveyor lines to clear. After stopping these components associated with the machine 10 and performing the automated stop-cutting operation (if necessary), the automated cutting operation ends.

Returning to FIG. 12*a*, if the interlocks are okay (at 401), the control system 250 starts the vacuum system 264 (at 412). In some embodiments, the control system 250 sends (e.g., wirelessly) a start command to the vacuum system 264 (e.g., using the transceiver 260). The control system 250 can also wait for feedback from the vacuum system 264 that confirms that the vacuum system 264 is running before the control system 250 continues the automated cutting operation. If the vacuum system 264 fails to start, an interlock can be set that forces the control system 250 to stop the automated cutting operation. In addition, if the control system 250 loses communication with the vacuum system 264 during the automated cutting operation, the vacuum system 264 remains running but can be stopped locally. The control system 250 can also monitor pressure of the vacuum system 264 during the automated cutting operation. If vacuum pressure drops below a predetermined minimum pressure value or if the vacuum system 264 is stopped locally, the control system 250 allows the current automated cutting operation to finish, but, when the cutting operation is complete, the control system 250 aborts the automated cutting operation and initiates an automated stop-cutting operation (see FIG. 13).

If the interlocks are okay (at 401, see FIG. 12*a*), the control system 250 also positions the machine 10 at a predetermined cutting starting position (e.g., the advance platform 168 and the arm 30). Because it is possible that the platform 168 and the arm 30 are moved manually using the remote control unit 261, moving the advance platform 168 and the arm 30 to a predetermined cutting starting position before starting cutting ensures that all cuts start from a predefined position. Therefore, positioning the machine 10 at the cutting starting position at the start of each automated cutting operation ensures consistent cutting. In some embodiments, the cutting starting position includes an advance cutting position, a swing cutting position, and a tilt cutting position.

To position the platform 168 and the arm 30 at the cutting starting position, the control system 250 (e.g., controller 2) accesses the stored cutting face coordinates and automatically operates the advance actuators 171 and 172 to advance or retract the advance platform 168 to the advance cutting position (at 414). In some embodiments, the advance cutting position is approximately 35 millimeters from the cutting face (i.e., from the advance face position included in the saved coordinates of the cutting face), which prevents the disc cutter assemblies 66 from dragging on the face when the arm 30 swings while still keeping the machine 10 close enough to the cutting face to prevent unnecessary tramming before and after cutting. Therefore, if the advance platform 168 is positioned approximately 32 millimeters or closer to the cutting face (i.e., from the advance face position), the control system 270 retracts the advance platform 168 to create ample room between the platform 168 and the cutting face to allow the arm 30 to swing. Alternatively, if the advance platform is approximately 38 millimeters or farther from the cutting face (i.e., from the advance face position), the control system 270 advances the advance platform 168 to position the platform 168 a proper (e.g., a minimum) distance from the cutting face.

Figure 12C:
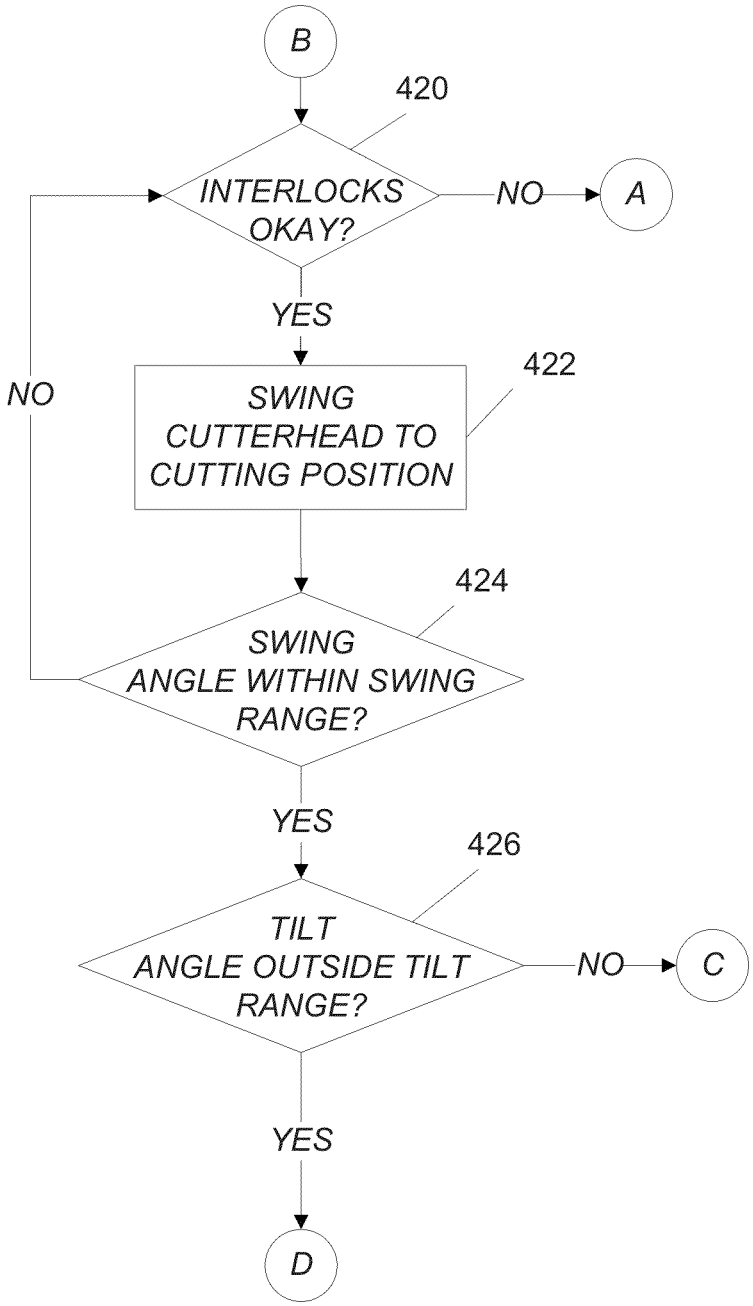

When the advance platform 168 is positioned to allow the arm 30 to clear the cutting face (e.g., is within approximately 33 millimeters to 37 millimeters from the cutting face) (at 416), the control system 20 determines if the current swing angle of the arm 30 is outside of an acceptable range of the swing cutting position (at 418). In particular, the control system 250 determines if the current swing angle of the arm 30 is more than 2 degrees from the swing cutting position. The swing cutting position can be a predetermined angle of the arm 30 where all cuts start from, such as approximately 12 degrees. As illustrated in FIG. 12*c*, if the current swing angle is outside of the acceptable range, the control system 20 determines if the interlocks are still okay (at 420) and automatically operates the swing actuators 160 and 164 to swing the arm 30 (e.g., clockwise or counterclockwise) to the swing cutting position (at 422). In some embodiments, while swinging the arm 30 to the swing cutting position, the control system 250 also starts the motors associated with the disc cutter assemblies 66. In other embodiments, as described below, the cutter motors can be started later during the automated cutting operation.

Figure 12D:
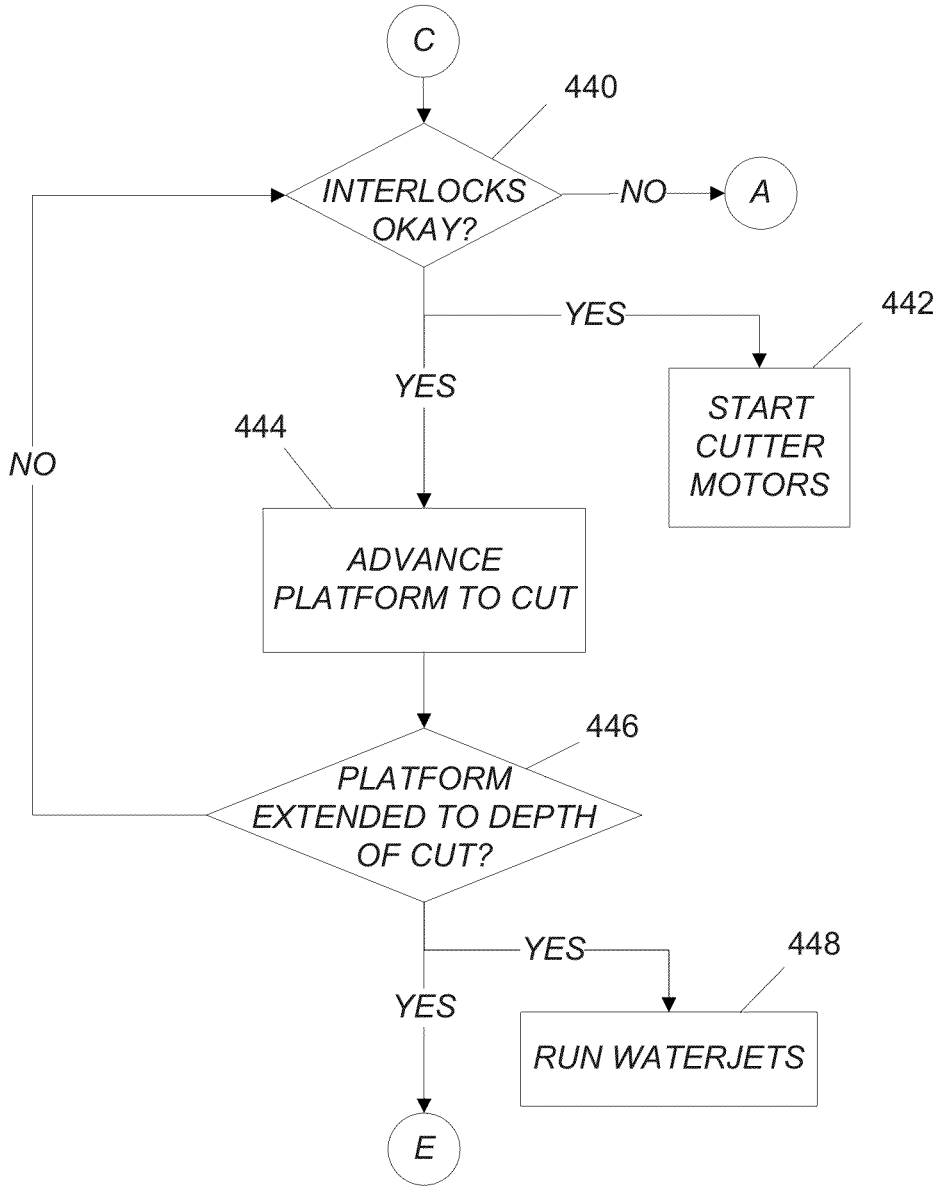
Figure 12E:
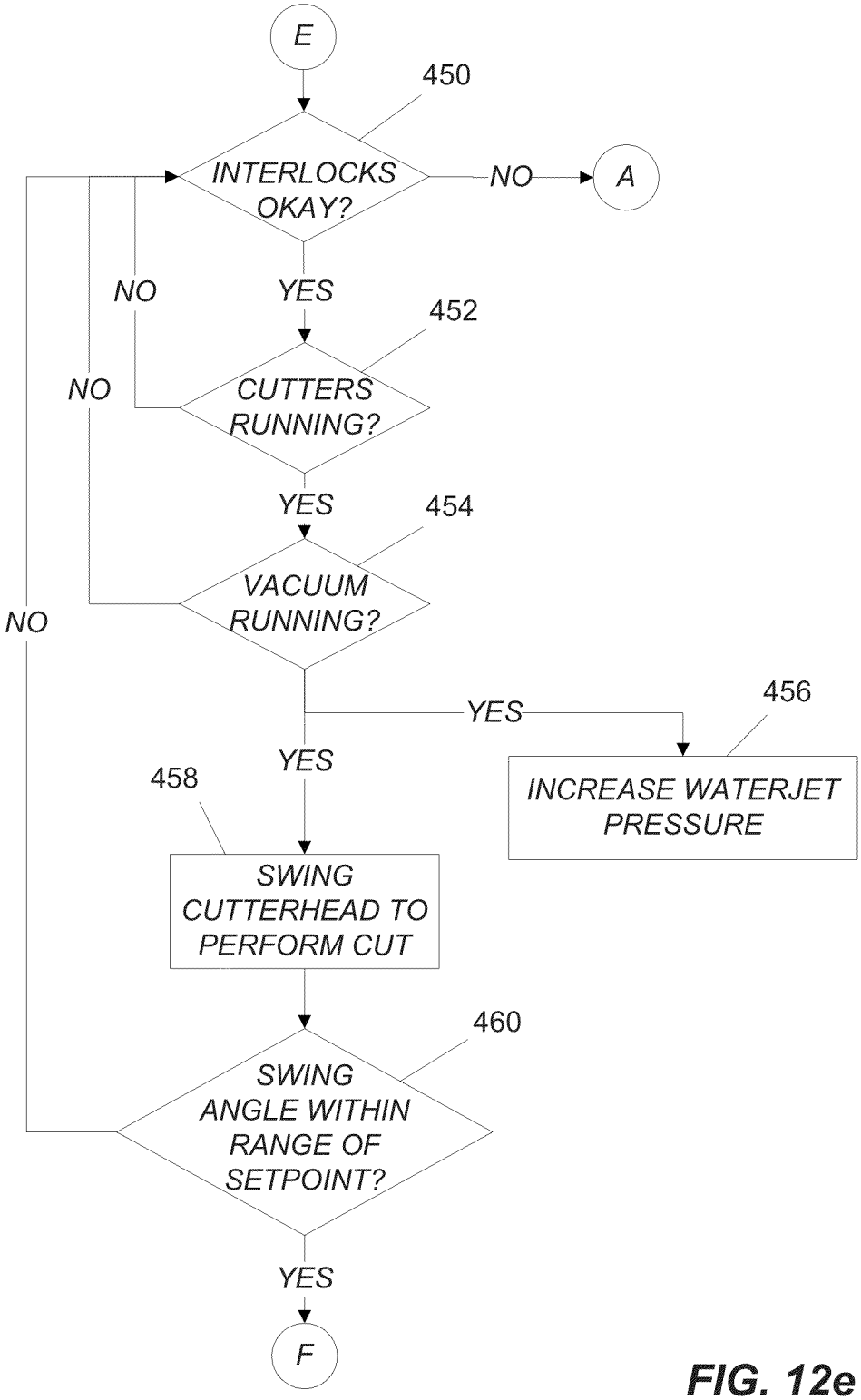
Figure 12F:
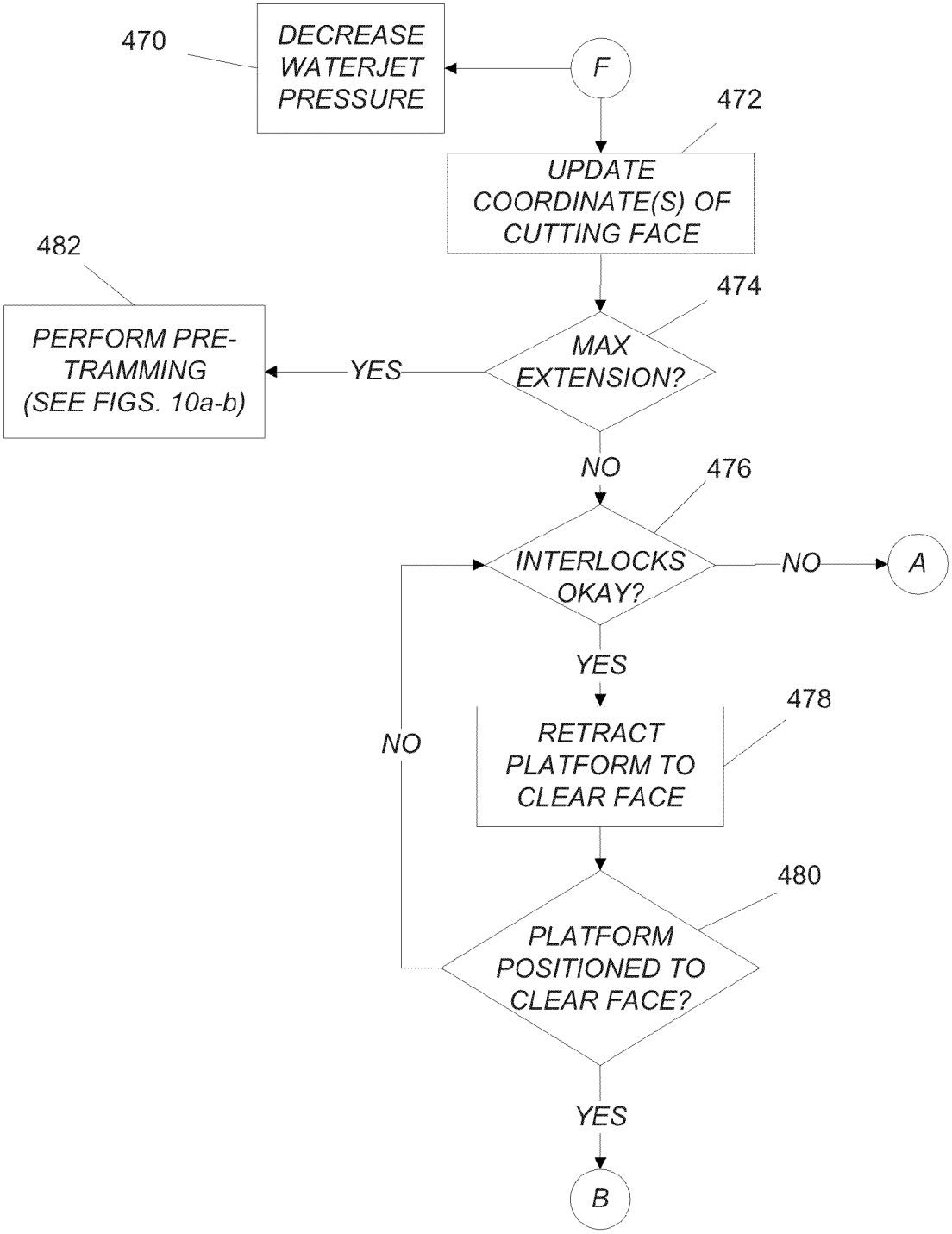
Figure 12G:
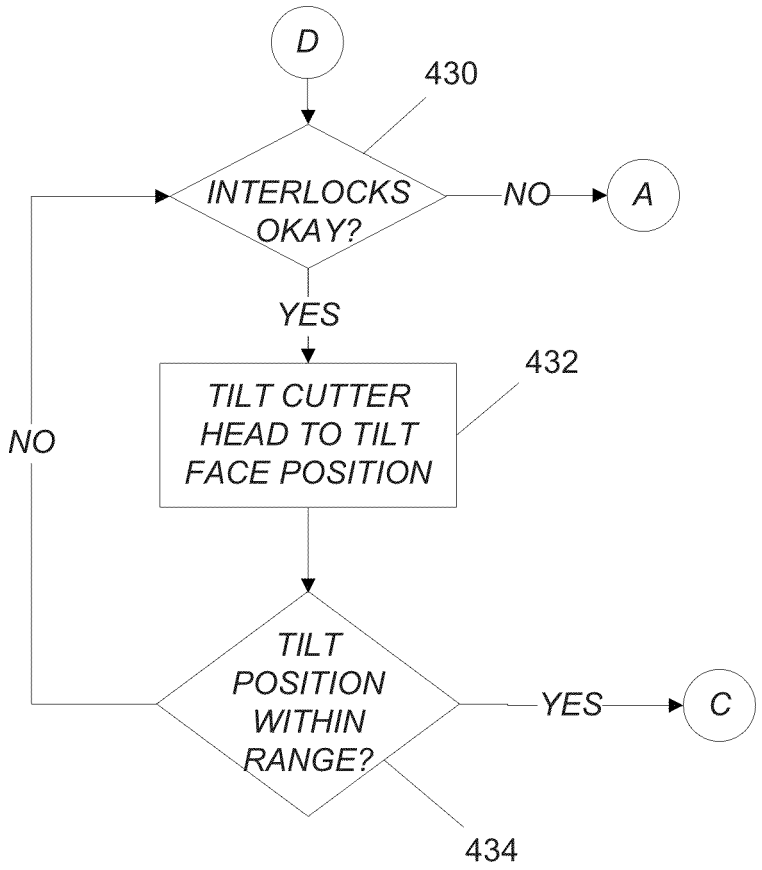

When the arm 30 is position at the swing cutting position (e.g., within approximately 1 degree from the swing cutting position) (at 424), the control system 250 determines if the arm 30 is at the tilt cutting position (at 426, see FIG. 12*g*). In particular, the control system 250 determines if the current tilt angle of the arm 30 is within approximately 2 degrees of the tilt cutting position. In some embodiments, the tilt cutting position is set to the tilt face position. Therefore, the control system 250 accesses the saved cutting face coordinates to determine how to tilt the arm 30. As illustrated in FIG. 12*g*, if the arm 30 is not at the tilt cutting position (e.g., the current tilt angle of the arm 30 is more than 2 degrees from the tilt cutting position) and while the interlocks remain okay (at 430), the control system 250 automatically operates the tilt actuator 237 to tilt the cutterhead 26 to the tilt cutting position (at 432).

When the advance platform 168 is positioned at the advance cutting position and the arm 30 is positioned at the swing cutting position and the tilt cutting position (or within acceptable ranges of each), the arm 30 and the advance platform 168 are positioned at the cutting starting position and cutting can start. In particular, as illustrated in FIG. 12*d*, after the machine 10 is positioned at the cutting starting position, the control system 250 checks that the interlocks are okay (at 440) and starts the cutter motors (at 442). In some embodiments, the motors are started sequentially.

With the cutter motors running, the control system 250 automatically operates the advance actuators 171 and 172 to advance the platform 168 toward the cutting face until it exceeds the saved advance face position included in the coordinates of the cutting face by a predetermined depth value called the "depth-of-cut" (i.e., the maximum depth the reef will be cut as the cutterhead 26 swings clockwise) (at 446). In some embodiments, the control system 250 automatically controls the speed and position of the advance actuators 171 and 172 to ensure the speed and position of the actuators 171 and 172 are matched (e.g., to within approximately 0.1% error) to prevent unintended skewing of the advance platform 168 and, subsequently, the arm 30.

When the advance platform 168 reaches the depth-of-cut and with the cutter motors running, the control system 22 starts the water jets 99 to clear cut material from the faces of the disc cutter assemblies 66 (at 448). In some embodiments, the control system 250 initially runs the water jets 99 at a pressure of approximately 100 bar. As illustrated in FIG. 12*e*, after the water jets 99 are started, the control system 250 checks the interlocks (at 450), verifies that the cutter motors are running (at 452), and verifies that the vacuum system is running (at 454). In some embodiments, when the water jets 99 and the vacuum system pressures reach predetermined pressure values, the control system 250 increases the water jet pressure (at 456). For example, in some embodiments, the control system 250 increases the water jet pressure to the cutting pressure (e.g., 250 bar).

As illustrated in FIG. 12*e*, as the advance platform 168 reaches the depth-of-cut, the control system 250 also automatically operates the swing actuators 160 and 164 to swing the arm 30 (e.g., clockwise) (at 458), which cuts the reef in an arc. As described above, the control system 250 operates the swing actuators in a reciprocating fashion (i.e., one advances as the other retracts) to produce a circular or arcing motion of the cutterhead 26. The control system 250 uses a position of each swing actuator 160 and 164 to calculate an angle on the arc that the cutterhead 26 travels. In some embodiments, the control system 250 calculates the angle using actuator stroke applied to a mathematical algorithm (e.g., a polynomial curve). The control system 250 uses the calculated angle to determine a swing speed for the arm 30. In particular, the control system 250 controls the swing speed of the arm 30 based on a mathematical algorithm (e.g., a polynomial curve) that determines speed limits for a given swing angle. For example, the control system 250 can control the swing speed to follow a constant speed or a speed limit algorithm or control the set speed limits to adaptively swing the arm 30 in proportion to the cutter motor load. Therefore, the control system 20 controls the swing of the arm 30, and the associated cutterhead 26, to ensure that the cut is performed to a desired depth and width.

The control system 250 swings the arm 30 until the cutterhead 26 reaches a predetermined maximum swing angle (at 460). When the current angle of the arm 30 reaches the maximum swing angle (or is within approximately 1 degree of the maximum swing angle), the control system 250 reduces the pressure of the water jets 99 (e.g., 100 bar) (at 470, see FIG. 120. The control system 250 also updates the saved coordinates of the cutting face (e.g., stored in one of the controller's 252 computer-readable medium 272) (at 472). In some embodiments, the control system 250 updates the coordinates by adding the depth-of-cut to the advance face position included in the saved coordinates of the cutting face. Also, if horizon control is required, the control system 250 updates the tilt face position included in the saved coordinates of the cutting face based on a predetermined incremental horizon control value (e.g., adding or subtracting the incremental horizon control value to or from the saved tilt face position).

In addition, if the advance actuators 171 and 172 have not reached a maximum extension (which requires tramming of the machine 10 to re-position the machine 10 within range of the cutting face) (at 474) and while the interlocks remain okay (at 476), the control system 250 operates the advance actuators 171 and 172 to retract the advance platform 168 from the cutting face by the predetermined clearance distance (e.g., approximately 25 to approximately 35 millimeters) (at 480) to prevent the disc cutter assemblies 66 from dragging against the face as the arm 30 swings to the swing cutting position. When the platform 168 is positioned at the clearance distance (at 482) (e.g., the platform 168 is positioned at least approximately 25 millimeters from the updated cutting face), the control system 250 swings the arm 30 (e.g., counterclockwise) to the swing cutting position (at 422, see FIG. 12*c*). In particular, the control system 250 swings the arm 30 to the swing cutting position as described above and repeats the cutting cycle illustrated in FIGS. 12*c*-12*g*. In some embodiments, to perform subsequent cuts after the initial cut, the control system 250 advances the advance platform 168 by a distance equal to the depth-of-cut plus the clearance distance.

When the advance actuators 171 and 172 reach maximum extension (at 474), the machine 10 must be trammed to position the machine 10 at a new cutting starting position where the arm 30 can again be advanced into the cutting face. In some embodiments, when the actuators 171 and 172 reach maximum extension, the control system 250 activates the automated pre-tramming operation described above with respect to FIGS. 10*a-b* (at 482) and automatically trams the machine 10 after the machine has been automatically pre-trammed. After the machine is pre-trammed and trammed, the machine 10 can be operated (e.g., automatically) to perform additional cuts until the cumulative machine advance reaches a predetermined distance, which is approximately equal to the length of the power cable coupled to the machine 10. When this distance is reached, the machine must be trammed (e.g., backwards) and repositioned for subsequent cuts.

Stop-Cutting

Figure 13:
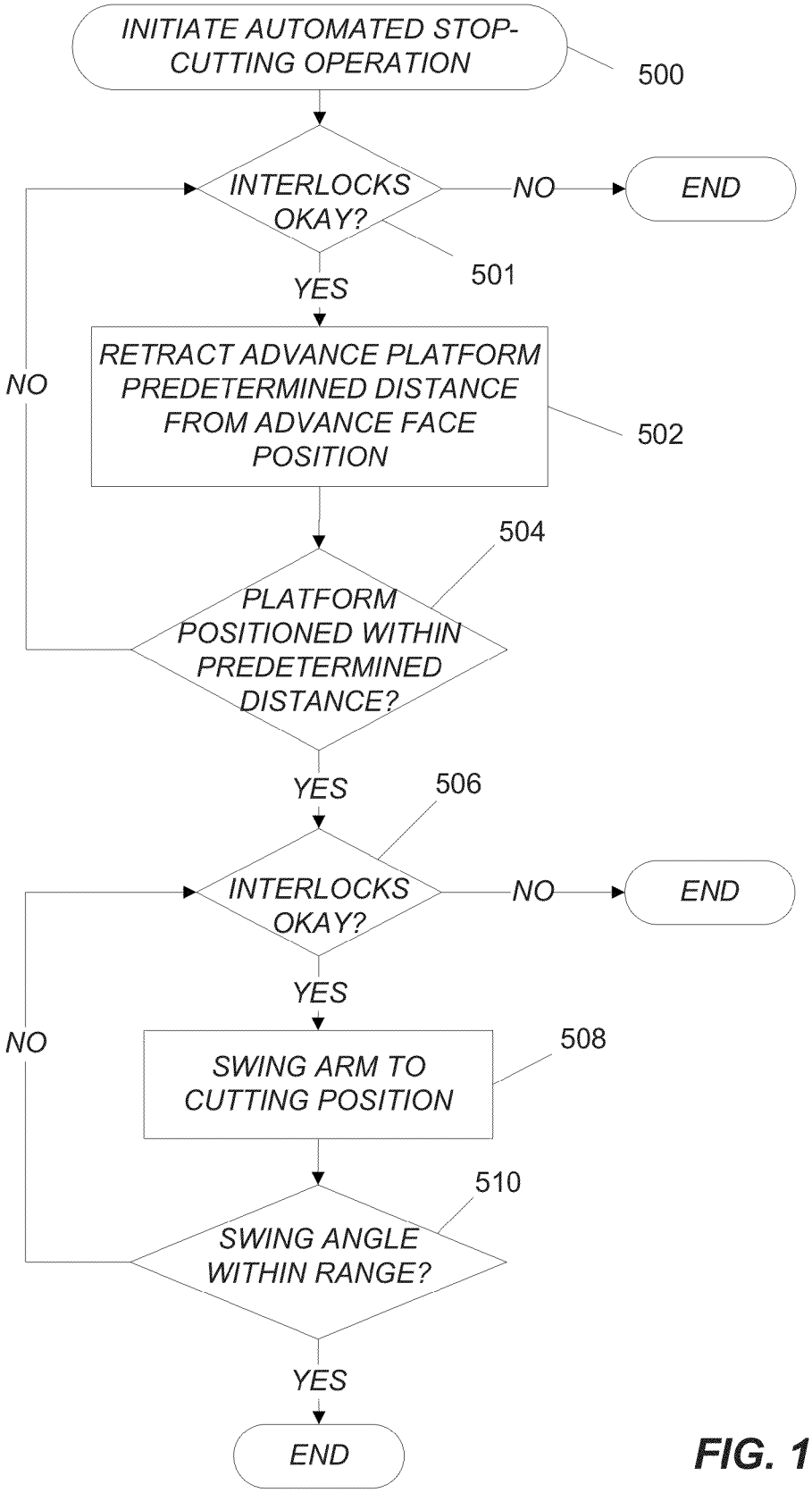
FIG. 13 is a flow chart illustrating an automated stop-cutting operation performed by the control system of FIG. 8.

As noted above, during the automated cutting operation, an operator can interrupt the current cutting cycle by pressing any button on the remote control unit 261 or by moving the joystick on the remote control unit 261, and the remote control unit 261 can send an "initiate" command to the control system 250. The control system 250 can also automatically interrupt a current automated cutting cycle if particular operating parameters exceed predetermined thresholds during the automated cutting cycle (e.g., if one or more machine interlocks are set or triggered). In some embodiments, when cutting is stopped (either manually or automatically), the control system 250 stops the cutter motors and aborts the automated cutting operation. The control system 250 can also perform an automated stop-cutting operation. In particular, as noted above with respect to FIGS. 9*a-c*, the controllers 252 include software stored in the computer-readable media 272 and executable by a processor 270 to perform various automated operations of the mining machine 10. In some embodiments, the software includes instructions for performing an automated stop-cutting operation. FIG. 13 illustrates the automated stop-cutting operation performed by the control system 250 according to one embodiment of the invention.

In some embodiments, if an operator manually stops a current cutting cycle, an automated stop cutting operation is initiated. In addition, if certain operating parameters are exceeded during an automated stop cutting operation, the control system 250 automatically aborts the automated cutting operation and initiates the automated stop-cutting operation. For example, in some embodiments, control system 250 automatically stops the automated cutting operation when the advance platform 168 reaches a maximum extension during the automated cutting operation so that the machine can be repositioned for additional cutting sequences. The control system 250 can also automatically initiate the automated stop-cutting operation when particular non-emergency failures occur during the automated cutting operation. For example, the control system 250 can initiate the automated stop-cutting operation when (i) cutter motors currents or winding temperatures exceed predetermined values, (ii) cutter motor protection relay communication fails, (iii) any portion of the automated cutting operation fails to execute, (iv) oil is contaminated with water to a certain magnitude, (v) the cutter's hydrostatic bearing oil or water flow or pressure fails or is excessive, or (vi) the cutter's hydrostatic bearing oil temperature exceeds predetermined values. In some embodiments, the control system 250 uses information from the sensors 267 to determine if one or more of these conditions are occurring that trigger the automated stop-cutting operation.

Automating the stop cutting cycle ensures that cutting is efficiently and safely stopped and allows the machine 10 to safely recover from certain system failures that occur during the automated cutting operation (e.g., failures that do not require an emergency or non-emergency shut-down). In addition, in some embodiments, the automated stop-cutting operation also repositions the arm 30 and the advance platform 168 at a position that allows maintenance and other operational personnel to easily access the machine 10 and the components associated with the arm 30 (e.g., the disc cutter assemblies 66) to perform any desired maintenance. Furthermore, performing the automated stop-cutting operation also allows for speedy transition from one set of cuts to the next. In particular, the automated stop-cutting operation automatically positions the machine 10 in the tramming position, which prepares the machine 10 for subsequent cutting.

When the automated stop-cutting operation is initiated (at 500), the control system 250 performs the automated stop-cutting operation without requiring manual interaction. In particular, as shown in FIG. 13*a*, the control system 250 determines if the machine interlocks are okay (at 501). The control system 250 also automatically operates the advance actuators 171 and 172 to retract the advance platform 168 from the cutting face by a maintenance distance (at 502). In particular, the control system 250 retracts the advance platform 168 from the cutting face by approximately 50 millimeters from the advance face position included in the saved coordinates of the cutting face. Retracting the platform 168 from the cutting face by the maintenance distance allows the disc cutter assemblies 66 to clear the cutting face when the arm 30 swings.

When the advance platform 168 reaches the maintenance distance (e.g., is positioned within approximately 3 millimeters from the maintenance distance) (at 506) and while the interlocks remain okay (at 508), the control system 250 automatically operates the swing actuators 160 and 164 to swing the arm 30 to the tramming position (at 510). When the arm 30 is at the tramming position (e.g., within approximately 1 degree of the tramming position) (at 512), the automated stop-cutting operation ends.

Shutdown

Shutdown of the machine 10 can also be performed as an automated operation. In particular, as noted above with respect to FIGS. 9*a-c*, the controllers 252 include software stored in the computer-readable media 272 and executable by a processor 270 to perform various automated operations of the mining machine 10. In some embodiments, the software includes instructions for performing an automated shutdown operation. Using the automated shutdown operation allows the machine to go through a controlled shutdown (e.g., in response to a command from the remote control unit 261) that readies the machine 10 for a subsequent start. The controlled shutdown also aids machine preparation after a shift change, which reduces machine downtime.

Figure 14A:
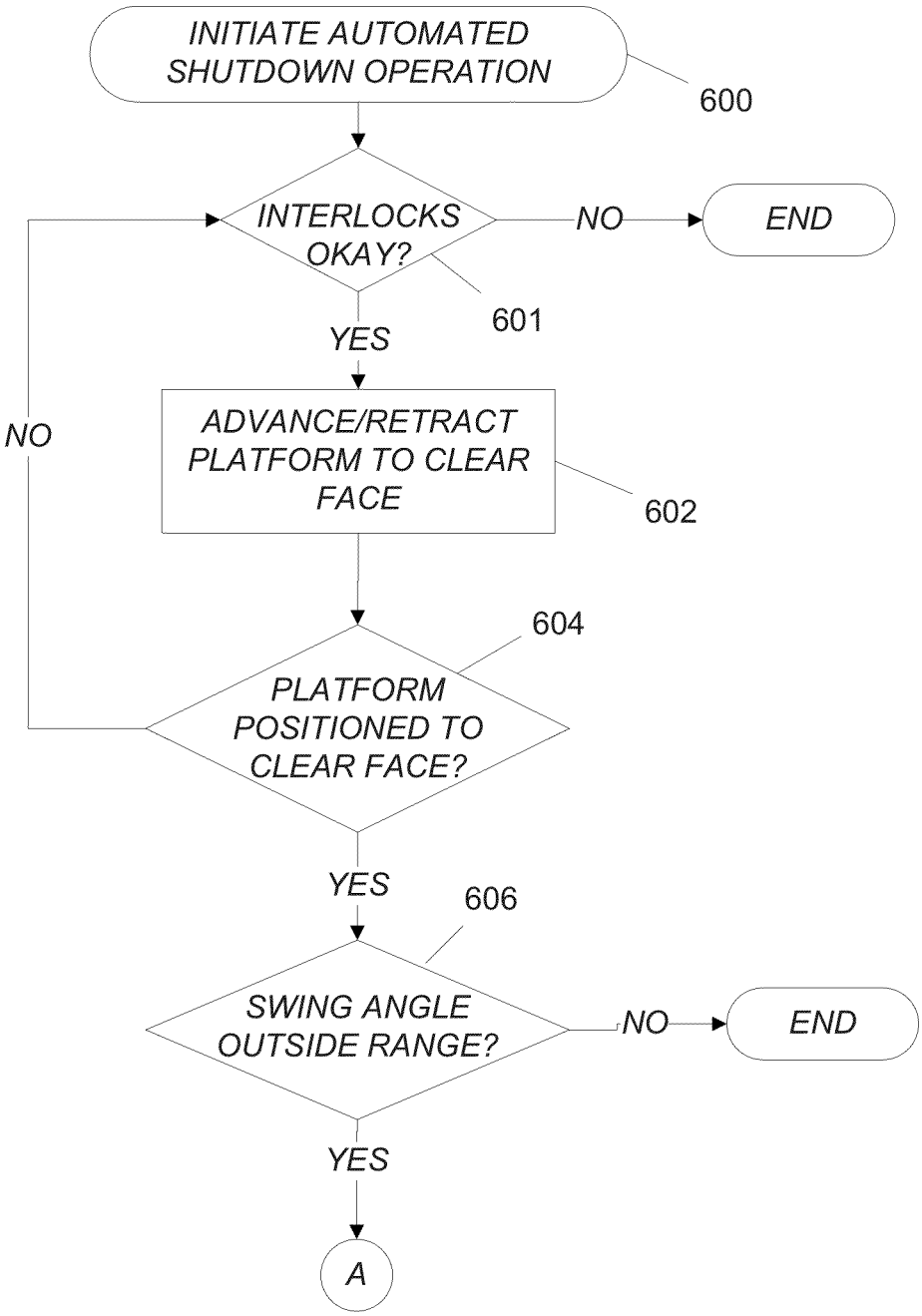
FIGS. 14*a-b* are flow charts illustrating an automated shut-down operation performed by the control system of FIG. 8.

In some embodiments, to initiate the automated shut-down operation, the operator presses and holds a shutdown button on the remote control unit 261 (e.g., for at least two seconds) when the pump unit 257 is running. The control system 250 can also automatically initiate the automated shut-down operation (e.g., based on a machine failure occurring during an automated cutting operation). After the automated shut-down operation is initiated (at 600), the control system 250 performs the automated shut-down operation without requiring manual interaction. In particular, as illustrated in FIG. 14*a*, the control system 250 determines if the machine interlocks are okay (at 601) and automatically operates the advance actuators 171 and 172 to advance or retract the advance platform 168 to the advance cutting position (e.g., approximately 1100 millimeters) (at 602).

Figure 14B:
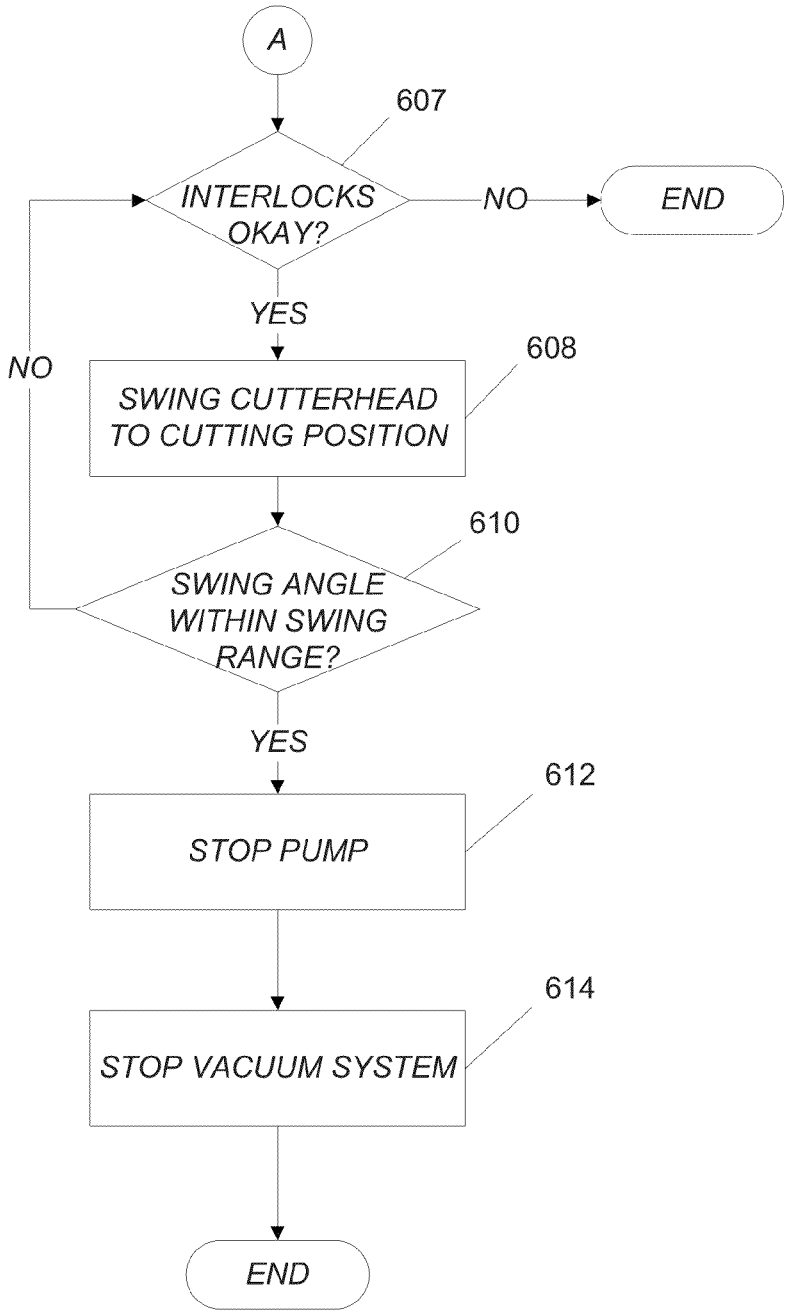

When the platform 168 reaches the advance cutting position (e.g., is within approximately 2 millimeters of the advance cutting position) (at 604), the control system 250 determines if the arm 30 is positioned at the swing cutting position (at 606). If the arm 30 is at the swing cutting position (e.g., the current angle of the arm 30 is within approximately 2 degrees of the swing cutting position), the automated shut-down operation ends. If the arm 30 is not at the swing cutting position (e.g., the current angle of the arm 30 is not within approximately 2 degrees of the swing cutting position) and while the interlocks remain okay (at 607, see FIG. 14*b*), the control system 250 automatically operates the swing actuators 160 and 164 to swing the arm 30 to the swing cutting position (at 608). In some embodiments, the control system 250 swings the arm 30 clockwise or counterclockwise depending on the position of the arm 30 relative to the swing cutting position. When the arm 30 reaches the swing cutting position (e.g., is within approximately 1 degree of the swing cutting position) (at 610), the control system 250 automatically stops the pump unit 257 (at 612) and the vacuum system (at 614) and the automated stop-cutting operation ends.

After the machine 10 is shutdown, an operator can power down the machine 10. When the machine 10 is isolated, all control power will be in the off state, but the controllers 252 may remain energized until batteries included in the machine discharge to predetermined minimum voltage. In addition, when the machine 10 is isolated, the controllers 252 can remain in the energized state but the outputs of the controllers 252 can be disabled to prevent the controllers 252 from performing any control functions. Furthermore, if the machine 10 is idle for a predetermined idle time, the control system 250 may automatically shut down the motor for the pump unit 257 as a safety precaution and to preserve energy.

In some embodiments, an emergency stop can also be performed. To initiate an emergency stop, an operator can press an emergency stop button located on the machine 10 or the remote control unit 261 or another external system or device (e.g., the SCADA). Pressing an emergency stop button constitutes an uncontrolled shutdown and the control system 250 immediately stops the pump unit 257.

It should be understood that, in some embodiments, during any of the automated operations described above, an operator can cancel the automated operation by pressing a particular or any button or mechanism (e.g., the joystick) on the remote control unit 261 or on another external system or device (e.g., the SCADA). In addition, parameters used during the automated operations described above can vary based on the mining environment, the material, and other parameters of the mining machine 10 and/or other machinery used with the machine 10. In some embodiments, the parameters can be manually set by an operator through the SCADA or another system or interface for obtaining machine parameters and providing the parameters to the control system 250.

Therefore, as described above, operations of a mining machine can be performed automatically. When performed automatically, a remote control unit 261 can be used to initiate an automated operation. Various checks and tests can be performed before, during, and after an automated operation to ensure that the operation is performed correctly and safely. By automating operations, the mining machine can be used more efficiently and under safer operating conditions.

Various features of the invention are set forth in the following claims.

What is claimed is:

1. A method for automatically operating a continuous mining machine, the method comprising:

accessing at least one coordinate of a cutting face stored in a computer-readable medium, the at least one coordinate specifying a position of a first actuator;

automatically operating the first actuator to position a platform a predetermined clearance distance from the at least one coordinate, the platform supporting a cutterhead; and automatically operating a second actuator to position an arm at a tramming position after positioning the platform the predetermined clearance distance from the at least one coordinate, the arm coupled to the platform and including the cutterhead.

2. The method of claim 1, further comprising receiving a command to initiate an automated pre-tramming operation from a remote control unit.

3. The method of claim 1, further comprising automatically checking at least one machine interlock; and automatically stopping automated operation of the mining machine when the at least one machine interlock has been set.

4. The method of claim 1, wherein automatically operating the first actuator includes automatically operating the first actuator to position the platform approximately 50 millimeters from the at least one coordinate.

5. The method of claim 1, wherein automatically operating the second actuator includes automatically operating the second actuator to position the arm approximately parallel with a longitudinal axis of the mining machine.

6. The method of claim 1, further comprising automatically operating the first actuator to position the platform at a predetermined cutting position after positioning the arm at the tramming position.

7. The method of claim 6, wherein automatically operating the first actuator to position the platform at the predetermined cutting position includes automatically operating the first actuator to position the platform at a minimum stroke of the first actuator.

8. The method of claim 6, operating the first actuator to position the platform at the predetermined cutting position includes automatically operating the first actuator to extend the first actuator from approximately 1097 millimeters to approximately 1103 millimeters.

9. The method of claim 1, further comprising tramming the mining machine.

10. The method of claim 1, further comprising:

(i) automatically operating the first actuator to advance the platform toward the cutting face until the cutterhead contacts the cutting face and pressurizes the first actuator to a predetermined pressure value, and (ii) saving the at least one coordinate of the cutting face based on a position of the first actuator when the first actuator is pressurized to the predetermined pressure value.

11. A system for automatically operating a continuous mining machine, the system comprising:

a platform;

an arm coupled to the platform and including a cutterhead;

a first actuator configured to move the platform linearly;

a second actuator configured to swing the arm horizontally; and a control system configured to perform an automated pre-tramming operation without requiring manual interaction by (i) accessing at least one coordinate of a cutting face stored in a computer-readable medium, the at least one coordinate specifying a position of the first actuator, (ii) operating the first actuator to position the platform a predetermined clearance distance from the at least one coordinate, and (ii) operating the second actuator to swing the arm to a predetermined tramming position after positioning the platform the predetermined clearance distance from the at least one coordinate.

12. The system of claim 11, wherein the predetermined clearance distance is approximately 50 millimeters.

13. The system of claim 11, wherein the tramming position includes a position of the arm approximately parallel to a longitudinal axis of the mining machine.

14. The system of claim 11, wherein the control system is further configured to automatically operate the first actuator to position the platform at a predetermined cutting position after positioning the arm at the tramming position.

15. The system of claim 14, wherein the predetermined cutting position is a minimum stroke of the first actuator.

16. The system of claim 14, wherein the predetermined cutting position is an extension of the first actuator from approximately 1097 millimeters to approximately 1103 millimeters.

17. The system of claim 11, wherein the control system is further configured to tram the mining machine.

18. The system of claim 11, wherein the control system is further configured to (i) automatically operate the first actuator to advance the platform toward the cutting face until the cutterhead contacts the cutting face and pressurizes the first actuator to a predetermined pressure value, and (ii) automatically save the at least one coordinate of the cutting face based on a position of the first actuator when the first actuator is pressurized to the predetermined pressure value.

19. The system of claim 11, wherein the cutterhead includes at least one oscillating disc cutter.

20. A system for automatically operating a continuous mining machine, the system comprising:

a platform;

an arm coupled to the platform and including a cutterhead;

a first actuator configured to move the platform linearly;

a second actuator configured to swing the arm horizontally; and a control system configured to (i) automatically access at least one coordinate of a cutting face, the at least one coordinate specifying a position of the first actuator, (ii) automatically operate the first actuator to position the platform a predetermined distance from the at least one coordinate, (iii) automatically operate the second actuator to swing the arm to a tramming position after positioning the platform the predetermined distance from the at least one coordinate, (iv) automatically operate the first actuator to position the platform at a predetermined cutting position after swinging the arm to the tramming position, and (v) tram the machine after the platform is positioned at the cutting position.

21. The system of claim 20, wherein the control system is further configured to perform steps (i) through (iv) in response to a command received from a remote control unit.

22. The system of claim 20, wherein the cutterhead includes at least one oscillating disc cutter.

* * * * *